US012685357B2

(12) United States Patent
Lee

(10) Patent No.: US 12,685,357 B2
(45) Date of Patent: Jul. 21, 2026

(54) COMPRESSION-TYPE TEXTURED STRAND FOR WIG AND METHOD FOR MANUFACTURING SAME

(71) Applicant: Hae Ju Lee, Seoul (KR)

(72) Inventor: Hae Ju Lee, Seoul (KR)

( * ) Notice: Subject to any disclaimer, the term of this patent is extended or adjusted under 35 U.S.C. 154(b) by 517 days.

(21) Appl. No.: 18/030,458

(22) PCT Filed: Oct. 8, 2021

(86) PCT No.: PCT/KR2021/013953
§ 371 (c)(1),
(2) Date: Apr. 5, 2023

(87) PCT Pub. No.: WO2022/075824
PCT Pub. Date: Apr. 14, 2022

(65) Prior Publication Data

US 2023/0371632 A1 Nov. 23, 2023

(30) Foreign Application Priority Data

Oct. 8, 2020 (KR) ..... 10-2020-0130478

(51) Int. Cl.
*A41G 3/00* (2006.01)
*A41G 5/00* (2006.01)
(Continued)

(52) U.S. Cl.
CPC ..... *A41G 3/0083* (2013.01); *A41G 5/004* (2013.01); *D02G 1/165* (2013.01); *D02G 1/205* (2013.01);
(Continued)

(58) Field of Classification Search
CPC ... A41G 3/0083; D02G 3/24; D02G 1/00–205
See application file for complete search history.

(56) References Cited

U.S. PATENT DOCUMENTS 3,910,291 A 10/1975 Kim
4,005,569 A * 2/1977 Corbiere ..... D02G 1/002 57/208
(Continued)

FOREIGN PATENT DOCUMENTS

CN 1696363 A 11/2005
CN 103492622 A 1/2014
(Continued)

OTHER PUBLICATIONS

International Search Report for Application No. PCT/KR2021/013953, dated Jan. 18, 2022.
(Continued)

*Primary Examiner* — Larissa Rowe Emrich
(74) *Attorney, Agent, or Firm* — MARSHALL, GERSTEIN & BORUN LLP

(57) ABSTRACT

Provided are a compression-type textured strand for a wig and a method for manufacturing same. The compression-type textured strand for a wig is carried in a compressed form and, by rapid application of tension thereto before it is worn, is enabled to recover its external shape. Therefore, the strand can satisfy both the economic feasibility of the logistics process and the aesthetic sensation when it is worn.

18 Claims, 18 Drawing Sheets

(51) Int. Cl.

| | |
|---|---|
| ***D02G 1/16*** | (2006.01) |
| ***D02G 1/20*** | (2006.01) |
| ***D04C 1/02*** | (2006.01) |
| ***D04C 1/12*** | (2006.01) |

(52) U.S. Cl.
CPC ..... *D04C 1/02* (2013.01); *D04C 1/12* (2013.01); *D10B 2321/022* (2013.01); *D10B 2321/041* (2013.01); *D10B 2331/04* (2013.01); *D10B 2401/063* (2013.01); *D10B 2503/08* (2013.01)

(56) References Cited

U.S. PATENT DOCUMENTS

| | | | | |
|---|---|---|---|---|
| 11,060,209 | B2 | 7/2021 | Lee | |
| 2007/0238389 | A1 | 10/2007 | Kobayashi | |
| 2009/0126749 | A1* | 5/2009 | Shirakashi | D01F 8/12 132/56 |
| 2013/0287990 | A1 | 10/2013 | Katagi | |
| 2017/0360133 | A1* | 12/2017 | Lee | A41G 3/0083 |
| 2020/0397079 | A1* | 12/2020 | Lee | D02G 3/26 |

FOREIGN PATENT DOCUMENTS

| | | | | | |
|---|---|---|---|---|---|
| CN | 111050585 | A | | 4/2020 | |
| GB | 1356652 | A | | 6/1974 | |
| JP | 2013/002014 | A | | 1/2013 | |
| KR | 100556035 | B1 | | 3/2006 | |
| KR | 10-2013-0094303 | A | | 8/2013 | |
| KR | 10-2017-0141571 | A | | 12/2017 | |
| KR | 10-2048283 | | | 6/2018 | |
| KR | 10-2019-0087335 | A | | 7/2019 | |
| KR | 10-2019-0087336 | A | | 7/2019 | |
| KR | 20190087336 | A | * | 7/2019 | A41G 5/0046 |
| WO | WO-2012/007333 | A1 | | 1/2012 | |
| WO | WO-2019/031635 | A1 | | 2/2019 | |

OTHER PUBLICATIONS

Office Action (with English translation) for Korean Patent Application No. 10-2021-0134474, dated May 25, 2023.

Examination Report from African Regional Intellectual Property Organization (ARIPO) Patent Application No. AP/P/2023/014796, issued Aug. 27, 2025.

* cited by examiner

COMPRESSION-TYPE TEXTURED STRAND FOR WIG AND METHOD FOR MANUFACTURING SAME

CROSS-REFERENCE TO RELATED APPLICATION

This present application is the US national phase of International Patent Application No. PCT/KR2021/013953, filed Oct. 8, 2021, which claims priority to Korean Application No. 10-2020-0130478, filed Oct. 8, 2020. The priority application, KR 10-2020-0130478, is hereby incorporated by reference in its entirety.

TECHNICAL FIELD

The present invention relates to a compression-type strand of textured filament for wigs and a method of preparing the same.

BACKGROUND ART

Various products of wigs are presented according to race, age and gender, and wigs are selected to have a specific form or shape according to the purpose of use. Among the various products, wigs for Black people having various forms or shapes have been proposed.

Traditionally, wig products for Black people may be classified into four categories according to how they are worn, and may be classified as: wigs that cover the head; weavings which are attached to braided hair path named corn rows formed using a end consumer's own hair with sewing or glue along the path; drawstrings which are kind of half wigs connected to hair of an end consumer (wearer) through a string that can be pulled; and finally, braids connected (by braiding or twisting) to a partially collected hair group of end consumer's own hair. In addition, to these braids, a group called special braid was recently added, and this has a kind of ring (pre-loop) on top of the braid product to allow an end consumer to use a tool called a crochet needle to easily connect the braid to his or her hair group or hair path. Recently, according to typical wearing methods wig products are reduced to three categories: wigs, weaving, and braids.

In view of the style after finally wearing an entire wig, wigs and weaving are classified as a style in which wig filaments are made by weaving with a sewing machine such that waves and curls are made individually according to filaments in a weft state (hereinafter referred to as "weft style") or as a style that pursues diversity based on strands in which a certain amount of filaments are grouped (hereinafter referred to as "braid style"). The market price is in the order of wigs, weaving, special braids, and normal braids, with wigs being the most expensive items.

Recently, a wig accessory called a "braid cap" is popular, and this is a kind of cap that acts as a kind of head skin made by attaching corn row braided hair made of chemical fiber instead of real hair of a Black end consumer. As the name implies, connecting a braid on a braid cap using a crochet may turn the braid cap into an expensive braid style wig that is convenient to attach and detach. However, when the lightweightness of this braid is not secured, it is difficult for the braid cap to maintain adhesion with the actual scalp of an end consumer, and thus, there may be anxiety that the braid cap will be detached (anxiety of not being like one's own hair). Thus, despite the advantage of upgrading the braid to a wig, the braid cap failed to become popular in practice.

The lightweightness range to overcome this problem is generally within about 300 grams, preferably within 200 grams, or more preferably within 100 grams, based on 20 to 24 inches, to cover the scalp of an end consumer, and this range is also desirable in the aspects of aesthetics or convenience. In addition, it may be easy to enter the market in accordance with economic feasibility only when the production cost is lowered by mechanical automation by breaking away from labor-intensive manual manufacturing methods.

The final wear style of braids, which accounts for 70% of the Black wig market, is classified into 6 categories: twist braid, box braid, LOC braid, curly braid, Marley braid, Kinky braid, or wet look braid. The most representative among lightweight braids is a product called Marley braid or Kinky braid, which is a special style in terms of beauty and maintains a constant trend. From a macroscopic point of view, Marley braid or Kinky braid may have similar appearance characteristics, but when compared from a microscopic point of view, the texture of wig filaments is in a different state. Kinky braid and Marley braid are also known collectively as Marley braid.

When three values required for wig products are on triangular vertex positioning (TVP), beauty (aesthetics), convenience and economic efficiency will be placed at the vertex. Among the six representative braids, the braid that requires the most labor, i.e., a complex process, is Marley braid. Thus, Marley braid is the most expensive braid. Because Marley braid satisfies beauty and convenience sufficiently, Marley braid maintains a trend for a long time, however, there is a certain limit to market expansion due to the high price of Marley braid.

Therefore, in order to reduce labor intensiveness, research on a method for automatic production of Marley braid has been steadily conducted in the art, but more than 30 years have passed without an innovative method developed. Therefore, the market demand for the method is very high.

As described above, in order for a braid-style wig to be selected by end consumers, braid should be bulky enough like Marley braid, and the weight in the worn state should be within about 300 grams to 200 grams or preferably within 100 grams, based on 22 to 24 inches per end consumer. However, as compared with other braids, Marley braid has an obstacle to expansion of the market because the manufacturing process is complicated, demanding, and expensive. Therefore, when the automatic production process of Marley braid is developed, market expansion and popularization may be achieved.

The manual manufacturing process of Marley braid is as follows.

1) First, crimping 2 to 3 types of wig filaments with different shrinkage speeds and shrinkage rates under the same calorific conditions.
2) After cutting the filaments for each hair length, blending the filaments using a hackle (large comb) to mix filament by filament leading to the length distribution.
3) After dividing the mixed wig filaments into groups, twisting the each groups with two strands.
4) Heating the grouped two strand twists at a high temperature of 120° C. to 150° C. using a hot air dryer for about 1 hour to prepare an over-shrunk twist braid.
5) Separating two strands of the over-shrunk twist, while each strand is divided (opened) into filaments and hackled in a length direction. The hackled strands are usually packed into about 20 (about 70 grams) and shipped to market.

Expensive braids manufactured by such a complicated five-step labor-intensive process have no choice but to be limited in the market. The industry is making various attempts to develop such braids. Korean patent application No. KR 2018-0069686 describes a changeable multi-braid (CMB), which has gone through the third stage of the process, not to the final stage from a wig factory, which allows end-users to make Marley braid products using a heat supply means of hot water. The CMB gives various style options to consumers by passing the process effort from a manufacturer to an end consumer, which is far from low-cost automated mass production. Korean patent No. KR 2,078,793 describes the method for producing texture-based LOC braid and the development of morphological characteristics thereof. The patent achieves a certain level of lightweightness by securing space volume within a strand through texture, but the braid has a level of lightweightness that requires at least 300 g to 500 g of weight to cover the scalp of an average consumer. If weight reduction was maximized during the development of this production process, there would be a cost problem during packaging and logistics due to the volume. For that reason, it seems that LOC braid with a certain density was suggested.

In detail, bulk density (BD), which may be an indicator of lightweightness, may be in a range of 2,000 $cm^3$ to 3,000 $cm^3$ based on 20 inches (half-folded hair) of the average consumer's head skin coverage volume (CV). Based on the conversion of this range, a lightweight braid having a BD of 0.2 to 0.02 (400 to 60 grams), preferably 0.15 to 0.033 (300 to 100 grams), or more preferably 0.1 to 0.033 (200 to 100 grams) ($g/cm^3$), is required to be manufactured. It is considered that a braid cap wig at an economic price may only be realized when such a lightweight braid is manufactured through a simple process.

This continuous invention attempt in the art reflects the very need for mass productivity of such a lightweight braid.

DESCRIPTION OF EMBODIMENTS

Technical Problem

The goal of the present invention is to provide a textured strand for a wig and a method of preparing the same which may reduce transport costs by reducing volume and allowing the volume to be restored and worn after transport.

Solution to Problem

An aspect of the present invention relates to:

a compression-type strand of textured filament for wigs, wherein the strand may include at least one of macro-curl textures, macro-wave textures, and micro-flexural textures, in a cross-section of the strand, there may be in a range of 30 to 4,000 filaments from a core to a sheath, the filaments may include at least one of an amorphous organic polymer, a semicrystalline organic polymer, or an alloy thereof, the filaments may each have a thickness in a range of 20 denier to 180 denier, the cross-section of the strand may have a circular shape, an elliptical shape, a polygonal shape, or a combined shape thereof, and when a cross-sectional area is converted into an area of a circular shape, a converted diameter (R), i.e., a diameter of the circular shape, may be in a range of 0.2 centimeters (cm) to 3.0 cm, a specific volume density (SVD) of the strand, represented by Equation (2), i.e., a ratio of a real density (RD) to bulk density ($BD_0$), is in a range of 2 to 30:

$$SVD_0=RD/BD_0=BV_0/RV \quad (2)$$

wherein, in Equation (2), a real density (RD) of the strand is a density of the filaments, the bulk density ($BD_0$) of the strand is a density according to a bulk volume ($BV_0$), i.e., a volume occupied by appearance of the strand, and RV is a volume occupied by the filaments, a length of the strand before pulling the strand out may be defined as an initial length ($d_0$), wherein a converted diameter of the strand may be $R_0$, and a bulk volume of the strand may be $BV_0$, a length of the strand in a state in which filaments in the strand is as stretched as possible without elongation or breaking may be a tensile length ($d_1$), pulling the strand at a speed of 150 mm/sec to the tensile length (PO distance) ($d_1$) and releasing the strand 5 seconds later may be defined as rapid tension application (pull-out, PO), a length of the strand that has undergone the rapid tension application (PO) and been left for one day under conditions of 40° C. and a relative humidity (RH) of 60% may be defined as an extended length ($d_2$) of the strand, wherein a converted diameter of the strand may be $R_2$, and a bulk volume of the strand may be $BV_2$, and when the initial length ($d_0$) is 100 mm, an increase ratio of SVD ($SVD_{ratio}$) of the strand after the rapid tension application (PO), which may be represented by Equation (3), may be in a range of 1.5 to 8:

$$SVD_{ratio}=SVD_2/SVD_0=BV_2/BV_0 \quad (3)$$

wherein, in Equation (3), $SVD_0$ and $SVD_2$ respectively indicate SVD before and after the rapid tension application (PO), and SVD may be increased due to extension in a length direction (X axis) of the strand and at least one of perpendicular directions of the length direction (X axis).

In some embodiments, after performing the rapid tension application (PO) to the strand, an increase ratio of area ($S_{ratio}$) of a vertical cross-section of the strand, represented by Equation (4), may be 1.5 times to 7 times:

$$S_{ratio}=S_2/S_0 \quad (4)$$

wherein, in Equation (4), $S_0$ and $S_2$ respectively represent the cross-sectional areas of the strand before and after the rapid tension application (PO).

In some embodiments, an increase in a bulk volume (BV), which determines the SVD, comprises extension of the strand in a length direction (X axis) to which the rapid tension application (PO) is applied and at least one of perpendicular directions of the length direction (X axis).

In some embodiments, after the rapid tension application (PO), the cross-section of the strand may be extended while maintaining a shape before the rapid tension application (PO).

In some embodiments, the strand may include macro-wave textures, and after the rapid tension application (PO), the macro-wave textures of the strand may be extended while maintaining a shape before the rapid tension application (PO).

In some embodiments, a shape strain rate of the strand after the rapid tension application (PO), which may be represented by Equation (8), may be less than 10%:

$$\text{Shape strain rate}=(L_2-L_1)/L_2\times 100 \quad (8)$$

wherein, in Equation (8), after the rapid tension application (PO), $L_1$ represents a length of the strand immediately after the strand is vertically hung under a condition of 40° C. and an RH of 60% and may be 24 inches, and after the rapid tension application (PO), $L_2$ represents a length of the strand after vertically hanging the strand of a length ($L_1$) of 24 inches under a condition of 40° C. and an RH of 60% for 24 hours.

In some embodiments, the filaments of the strand may each have a thickness in a range of 30 denier to 150 denier, a flexural strength of the polymer constituting the filament may be in a range of 300 kgf/cm$^2$ to 1,300 kgf/cm$^2$, and a flexural modulus of the polymer constituting the filaments (based on ASTM D790) may be in a range of 13,000 kgf/cm$^2$ to 36,000 kgf/cm$^2$.

In some embodiments, the filaments of the strand may each have a thickness in a range of 30 denier to 150 denier, a flexural strength of the polymer constituting the filament may be in a range of 600 kgf/cm$^2$ to 1,200 kgf/cm$^2$, and a flexural modulus of the polymer constituting the filaments (based on ASTM D790) may be in a range of 20,000 kgf/cm$^2$ to 35,000 kgf/cm$^2$.

In some embodiments, the strand may be in a LOC braid type,

SVD before the rapid tension application (PO) may be in a range of 3 to 15, and an increase ratio of SVD ($SVD_{ratio}$) due to the rapid tension application (PO) may be in a range of 1.5 to 6.

In some embodiments, the strand may be in a LOC braid type, a change to a Marley braid type may occur due to the rapid tension application (PO), wherein macro-wave textures and micro-flexural textures may be simultaneously expressed in the Marley braid type, SVD before the rapid tension application (PO) may be in a range of 5 to 20, and an increase ratio of SVD ($SVD_{ratio}$) due to the rapid tension application (PO) may be in a range of 2 to 8.

In some embodiments, the strand may be a curly braid type,

SVD before the rapid tension application (PO) may be in a range of 10 to 30, and an increase ratio of SVD ($SVD_{ratio}$) due to the rapid tension application (PO) may be in a range of 2 to 8.

In some embodiments, the strand may be a twist braid (cross twisted filament-bundle) type, SVD before the rapid tension application (PO) may be in a range of 2 to 10, and an increase ratio of SVD ($SVD_{ratio}$) due to the rapid tension application (PO) may be in a range of 1.5 to 4.

In some embodiments, the strand may be in a box braid (braided filament-bundle) type, SVD before the rapid tension application (PO) may be in a range of 2 to 10, and an increase ratio of SVD ($SVD_{ratio}$) due to the rapid tension application (PO) may be in a range of 1.5 to 4.

In some embodiments, the strand may include one or more of a rotational-twisted or spiral-twisted filament-bundle, the strand may be a textured compressed high-density (closely contacted) compression-type strand of TM braid type by grouping a plurality of TM bundles, the strand may be separated into as many as a number of rotational-twisted or spiral-twisted bundles, and SVD of each separated bundle before the rapid tension application (PO) may be in a range of 3 to 10, and an increase ratio of SVD ($SVD_{ratio}$) of each of the rotational-twisted or spiral-twisted bundles after the rapid tension application (PO) may be extended to 1.5 to 6, and each of the rotational-twisted or spiral-twisted bundles may be converted into a lightweight distorted LOC braid in which irregular waves may be expressed.

In some embodiments, the strand may exhibit outward curls, and the outward curls may be formed in one of an S direction (right) and a Z direction (left).

In some embodiments, the strand may exhibit outward curls, and

An S direction (right) and a Z direction (left) may alternately appear in the outward curls.

In some embodiments, the filaments may include at least one of an amorphous polymer, a semicrystalline polymer, or an alloy thereof.

In some embodiments, the length of the strand may be 2 meters (m) or longer.

Another aspect of the present invention relates to a method of preparing a compression-type strand of textured filament for wigs, the method including:

supplying a plurality of wig filaments for use in wigs;

texturing the filaments;

compressing and accumulating the textured filaments; and cooling the compressed and accumulated filaments.

Another aspect of the present invention relates to a method of converting a compression-type strand of textured filament for wigs, wherein the compression-type strand may have an increase ratio of SVD ($SVD_{ratio}$) of the strand in a range of 1.5 to 8 by applying rapid tension (PO).

Advantageous Effects of Disclosure

The compression-type strand of textured filament for wigs according to an aspect of the present invention may obtain a high-density (close contact) strand with excellent morphological stability through high-density (close contact) clustering by compression. Since the volume of the strand is reduced due to high-density (close contact), the logistics cost of the transport process may be reduced. After being transported to the end consumer, the volume of the compressed strand may be expanded and restored to a usable state through a simple process of rapid tension application (PO).

BEST MODE

Figure 1:
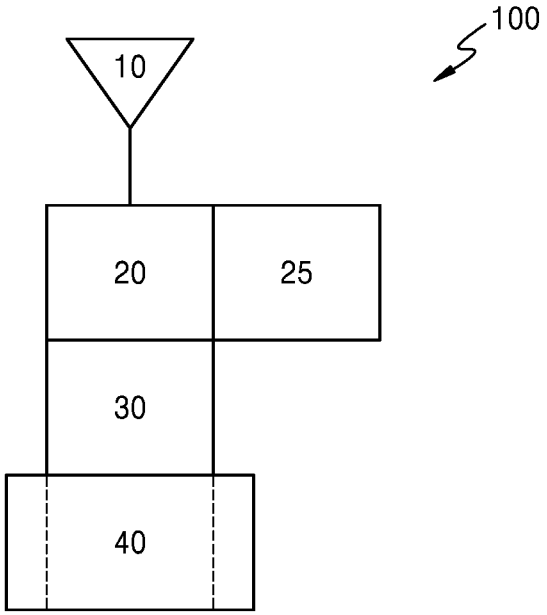
FIG. 1 is a conceptual view for describing a system for manufacturing a compression-type textured strand used in an embodiment.

In the present invention, a compression-type strand of textured filament for wigs was developed, in which the compression-type strand is easy to be in a bulk style by applying instantaneous tension (rapid tension) in a strand length direction by pulling out (PO) the strands so as to change macro-textures or micro-textures of filaments to be almost straight as long as the filaments in the strand do not break or elongate.

Unlike deformation of appearance in which a length of a strand is shortened along with an increase in a cross-sectional area in a vertical direction due to general heat shrinkage deformation, the strand according to the present invention may have an increase in length and an increase in an external cross-section of the strand at the same time by applying rapid tension (PO). Therefore, after completion of a low-cost logistics process of a strand in a compressed state due to volume reduction, it is possible for the strand to be worn by volume up or bulking up by applying rapid tension (PO).

The compression-type strand of textured filament for wigs according to the present invention may be manufactured by performing a compression process together with a texturing process of filaments of a strand according to embodiments.

As used herein, a "density of a strand" refers to the weight of a strand occupying a certain space. For example, when a strand is compressed in a packing box of a certain volume, the density of the strand is a value of the weight of the strand in the packing box divided by the volume of the packing box.

As used herein, a "compression-type strand" or "compressed strand" refers to a strand that, by compressing the strand, has a reduced volume as compared to the strand when worn by a user.

As used herein, a "continuous strand" refers to a strand made from a spun filament, which is not cut in length.

As used herein, a "lightweight strand" refers to a strand that has been decompressed and has a reduced density in contrast to a compressed strand.

As used herein, "LOC braid" refers to cylindrical braid including filaments with fine windings.

As used herein, "curly braid" refers to a type of braid including macro-curls.

As used herein, "Marley braid" refers to braid including both macro-curls and fine windings. Marley braid may include characteristics of both LOC braid and curly braid.

As used herein, "twist braid" refers to braid in which two groups of filaments are mutually rotated (twisted).

As used herein, "box braid" refers to braid in which three groups of filaments are twisted to form braid.

As used herein, "rotational twist or spiral twist" refers to a state of filaments or a group of filaments having their own rotation or twist without crossing with other filaments or a group of filaments.

As used herein, "TM braid" refers to a type of braid in which 1 group of filaments are rotated.

As used herein, "wet look braid" refers to braid in a form of filaments fused to each other.

(Method of Preparing Compression-Type Strand of Textured Filament for Wigs)

A method of preparing a compression-type strand of textured filament for wigs according to one or more embodiments will be described in detail.

FIG. 1 is a conceptual view for describing a system for manufacturing a compression-type textured strand used in an embodiment. As shown in FIG. 1, a continuous strand manufacturing system 100 according to an embodiment may include a wig filament supply unit 10, a texturing unit 20, a heat supply unit 25, a compressive accumulation unit 30, and a cooling unit 40.

The wig filament supply unit 10 may supply a strand of filaments to the texturing unit 20. For example, the wig filament supply unit 10 may supply a strand of direct spun drawn filaments to the texturing unit 20. The wig filament supply unit 10 may optionally supply two stage-spun drawn filaments, instead of the direct spun drawn filaments, to the texturing unit 20.

The texturing unit 20, the compressive accumulation unit 30, and the cooling unit 40 may each have, for example, a pipe shape. The texturing unit 20 may be, for example, in a pipe shape including an air leak part (not shown) for inducing a turbulent flow of supplied hot air.

The heat supply unit 25 may be connected to the texturing unit 20, and in the texturing unit 20, a texture due to autonomic shrinkage may be formed on a filament by heat supplied from the heat supply unit 25. The heat supply unit 25 may supply, for example, hot air or hot water. The heat supply unit 25 may be, for example, a hot air nozzle or a hot water nozzle. In the case of a hot air nozzle or a hot water nozzle, according to a desired texturing degree, hot air or hot water heated to a temperature equal to or higher than a glass transition temperature (Tg) and less than a melting temperature (Tm) of a polymer constituting filaments, with pneumatic pressure or water pressure for example, 2 $kgf/cm^2$ to 8 $kgf/cm^2$, may be supplied. While turbulent flow of a heat transfer medium (such as pneumatic pressure or water pressure) is caused in the texturing unit 20, not only micro-texturing, such as irregularly fine windings, may be formed due to thermal shrinkage of the strand, but also macro-texturing, such as curls, may be formed depending on a direction or angle of the heat transfer medium supplied.

The compressive accumulation unit 30, as the texturing unit 20, may be in a pipe shape according to a final external cross-section of a strand, and the compressive accumulation unit 30 may compress the strand to a high density (to be closely contacted) by stacking the strand of textured filaments in a certain space. In addition, macro-textured waves may be generated, along with micro-textured windings formed in the texturing unit 20, by the compression of the strand and rotation of a stacking direction of the strand in the compressive accumulation unit 30. The macro-texture formed in the compression accumulation unit 30 may include texturing such as a wave generated by marks or pressure that may be generated during a densification (close contact) process or a compression process, in which filaments settle and accumulate in a pipe.

The micro-textured windings formed by turbulent flow and thermal shrinkage in the texturing unit 20 may be random directional textures. On the other hand, macro-textured waves that may be regularly generated while maintaining balance of supply in and release out of strands under determined process conditions in the compressive accumulation unit 30 may be textures having a certain directionality.

According to another embodiment, in addition to a compression means of a mold of the pipe shape described above, a strand may be compressed by passing strand through a heat tunnel while applying strand a rotational twist in order to apply tension in a vertical length direction of the strand itself or by using another device, such as a mutually counter-rotating twin screw.

The cooling unit 40 may be set such that a compressed state of a strand may not be deformed by cooling the compressed textured strand inside a pipe using cooling water outside the pipe.

Figure 2:
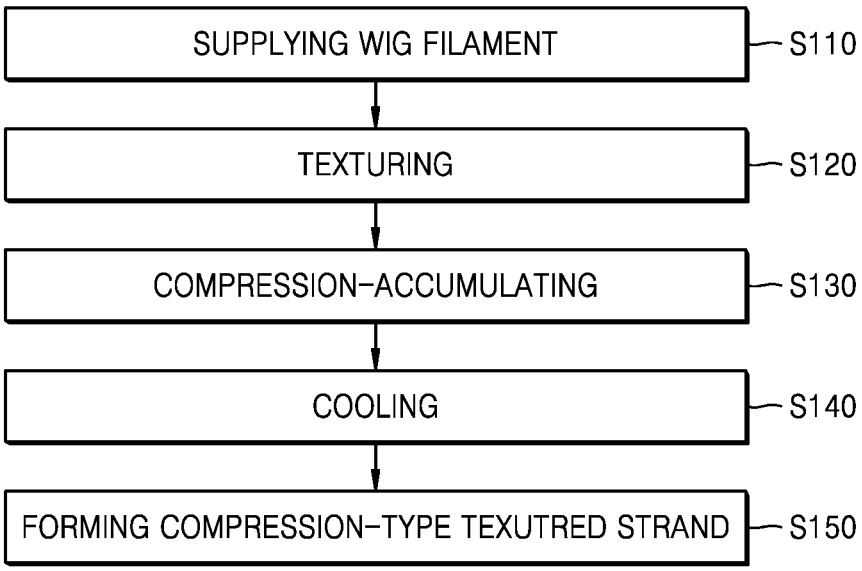
FIG. 2 is a flowchart sequentially describing a method of manufacturing a compression-type strand of textured filament for wigs, according to an embodiment.

FIG. 2 is a flowchart sequentially describing a method of manufacturing a compression-type strand of textured filament for wigs, according to an embodiment. In this embodiment, a compression method through a pipe-type mold may be used.

As shown in FIG. 2, first, wig filaments having appropriate properties may be supplied (S110). For example, pneumatic pressure may be used to supply wig filaments.

The wig filaments supplied in the process may consist of a polymer that may meet required characteristics for various styles, and the type of the polymer is not particularly limited. In some embodiments, the polymer may be an amorphous polymer or a semicrystalline polymer having a crystallinity of 30% or preferably 20% or less. Detailed examples of the polymer may comprise polyvinylchloride (PVC), polyvinylidene chloride (e.g., MODACRYL), polyester-based resins (PET, PBT, PTT, PEN, PCT, or the like), polypropylene (PP), polyethylene (PE), acrylic resin, polycarbonate (PC), polymethyl methacrylate (PMMA), polystyrene (PS), acrylonitrile-styrene-acrylate (ASA) resin, polyacrylate (PAR), polyphenylene sulfide (PPS), or a combination of two or more thereof. The combination of the polymers may be, for example, PC/ABS, PC/PET, or PC/PMMA.

The wig filaments may be manufactured through, for example, a direct spun drawn process or two stage spun drawn process, depending on a material, and the wig filaments may be manufactured to have appropriate thermal characteristics according to the characteristics of the desired final textured strand. Here, 30 filaments to 4000 filaments having a thickness of 10 denier to 180 denier (g/900 m), for example, 20 denier to 180 denier, for example, 30 denier to 150 denier, or for example, 40 denier to 100 denier, may be merged together or grouped by rotational twist or spiral twist to be supplied.

Then, an appropriate amount of heat may be supplied such that a texture may be expressed in the wig filament (S120). The heat for texture expression may be transferred to the wig filament, for example, by hot air or hot water. Hot air may be supplied at a pressure of, for example, 2 kgf/cm$^2$ to 8 kgf/cm$^2$ in a temperature range between the glass transition temperature (Tg) and the melting temperature (Tm) of the supplied wig filament. When the pressure of the hot air is less than 2 kgf/cm$^2$, productivity may be poor, and when the pressure of the hot air is greater than 8 kgf/cm$^2$, it may be difficult to control the process, but the pressure range is not limited thereto. When a wig filament is very sensitively textured, or when the compression accumulation unit has a texturing compression pipe having a small inner diameter, which makes it difficult to produce a strand having a desired thickness, pneumatic pressure of 2 kgf/cm$^2$ or less may be used. On the other hand, when wig filaments are not easily textured even when the temperature is raised to near the melting temperature (Tm), pneumatic pressure of 8 kgf/cm$^2$ or higher, for example, pneumatic pressure of 9 Kgf/cm$^2$ to 10 Kgf/cm$^2$, may be used. The temperature of hot air may be generally in a range of 60° C. to 280° C., although the temperature range may vary depending on the type of wig filament. In addition, depending on the shape of a desired strand, hot air may be supplied in various directions through at least one line.

Next, the textured wig filaments may be accumulated to be compressed to a certain level of adherence (S130). In the texturing (S120), textured filaments may be compressed and stacked in the certain space in the pipe. Here, the strand may be stacked, for example, in a spiral form, and the direction of the spiral form may be any one of an S direction (right) and a Z direction (left). The direction of the spiral form, in which the strands are stacked, may alternate, or the directions may be mixed. The strand may be stacked in a zigzag shape. Depending on the shape in which the strands are stacked, more windings, for example, curls, waves, or the like of the strand may be formed. Wig filaments may be stacked such that only micro-textures are formed, and macro-windings are not formed.

The cross-section of the tube in which the wig filaments are compressed may have a circular shape, oval shape, polygonal shape, or a combined shape that is a combination thereof. The polygonal shape may be, for example, an n-sided polygonal shape in which n is 3 or more, or a combined shape that is a combination thereof. The resulting cross-section of the compression-type textured strand may be a circular shape, oval shape, polygonal shape, or a combined shape that is a combination thereof, depending on the shape of the cross-section of the pipe.

Because most wig filaments are made from thermoplastic polymers, the wig filaments may have a residual shrinkable rate according to a process of spin draw. The residual shrinkage rate refers to a rate of self-shrinkage under certain conditions, for example, under constant temperature and constant pressure. The residual shrinkage rate may vary depending on tensile stress and heat (temperature and residence time) applied during manufacturing of the wig filament. Thus, when necessary, the residual shrinkage rate may be increased by adjusting conditions of the manufacturing process of wig filaments, but the residual shrinkage rate of the filament does not need to be high necessarily for texturing. This is because the texturing of filaments may be performed not only by thermal shrinkage but also by action of non-uniform flow and turbulent flow of hot air (heat transfer medium).

Because volume is reduced by densification (close contact) of the strand by compression, the space occupied by the strand may be minimized during transport.

Then, the strand may be cooled such that the high-density textured strand may not be deformed (S140). When the strand has a certain or higher degree of compression adhesion, a pushing force may be generated and may be discharged to the cooling unit. As the strand cools, the compressed state and shape of the high-density strand may be maintained without deformation. To cool the strand, for example, a cooling jacket may be installed around the pipe of the cooling unit, and for example, cooling water or a refrigerant may be circulated. The cooling water may be circulated by changing the temperature and/or flow rate according to the temperature of the compression unit on the cooling unit or the condition of the desired textured strand.

Through such a process, a compression-type strand of textured filament for wigs may be manufactured (S140). The cooled compression-type strand of textured filament for wigs may be transported in a packing box.

(Compression-Type Strand of Textured Filament for Wigs)

The compression-type strand of textured filament for wigs manufactured by the above-described manufacturing process will be described.

The compression-type strand of textured filament for wigs according to one or more embodiments may include 30 to 4000 textured filaments having a thickness of 20 denier to 180 denier, for example, 30 denier to 150 denier, or for example, 40 denier to 100 denier. In some embodiments, the filaments may include at least one of an amorphous organic polymer, a semicrystalline organic polymer, or an alloy thereof. The filaments may occupy from a core to a sheath, in a cross-section of the strand. The strand may have at least one of macro-textures such as curls or waves and micro-textures that are fine windings having random directionality. As used herein, the curls or waves of the strand may also respectively be called macro-curl textures or macro-wave textures. As used herein, the fine windings may also be called micro-textures or micro-flexural textures.

Figure 3:
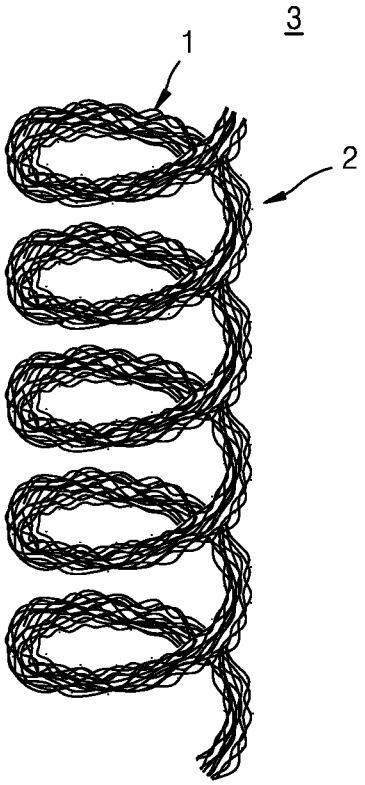
FIG. 3 is a conceptual view of a textured strand including micro-textures and macro-textures.

FIG. 3 is a conceptual view of a textured strand including micro-textures and macro-textures. As shown in FIG. 3, a textured strand 3 may have macro-textures of a wave shape 2 and micro-textures of fine windings 1.

The cross-section of a strand may be a circular shape, oval shape, polygonal shape, or a combined shape that is a combination thereof. The polygonal shape may be, for example, an n-sided polygonal shape in which n is 3 or more, or a combined shape that is a combination thereof. In some embodiments, when a cross-sectional area of the strand is converted into an area of a circular shape, a converted diameter (R), i.e., a diameter of the circular shape, may be in a range of 0.2 centimeters (cm) to 3.0 cm.

Specific Volume Density (SVD)

A strand may have a apparent density or bulk density (BD) or a real density (RD). The bulk density (BD) of the strand may be a value of a weight of the strand divided by a apparent volume or bulk volume (BV) of the strand. The BV of a strand is a volume occupied by the appearance of the strand, including a space between the filaments constituting the strand. The RD of a strand represents a density of a strand material that may not depend on the shape of the strand, and the BD of the strand represents a bulk density that may depend on the appearance of the strand. The specific volume density (SVD) of a strand is a ratio of RD to BD of the strand, which is equal to a ratio of the BV of the strand to the RV of filaments excluding the space within the strand. The SVD may be expressed by Equation 1:

$$SVD=RD/BD=BV/RV \quad (1)$$

The SVD of a strand may be obtained as a ratio of RD to BD by using BD obtained by measuring BV by weight and appearance of the strand of 1 m length, for example. Here, the BV may be obtained by measuring a total volume by outline of the strand under no tension and no pressure (no load) while laying down a 1 m-long strand straight on the floor with a ruler in a length direction. To this end, when only a sample of less than 1 m of a product is available in the market, a calculated value of 1 m corresponding to the measured value of the available sample may be used. For example, when a sample of 50 cm is measured, the value of the sample may be converted to a double value.

When a cross-section is not constant along the length direction of a strand, for example, for a 20 cm-long sample, the longest length and the shortest length of the cross-section may be measured at an interval of 1 cm, and the longest length and the shortest length of the cross-sections may be used as a long diameter and a short diameter of the converted ellipse to calculate cross-sectional areas, respectively. Then, an average of the cross-sectional areas of the converted ellipse may be multiplied by a length of the strand to calculate BV of the strand. For the RD of a strand, the density of the strand material may be used. However, when the RD is not known because the strand is made of a composite material, the RD of the strand may be measured by using an RD measuring device (AutoPycnometer 1320 manufactured by Micromeritics) and a pycnometer method using helium gas.

The SVD ($SVD_0$) of the compression-type textured strand according to one or more embodiments of the present invention before rapid tension application may be measured by Equation (2). The SVD ($SVD_0$) may be in a range of 2 to 30, for example 3 to 20, for example, 5 to 15, or for example, 6 to 10.

$$SVD_0=RD/BD_0=BV_0/RV \quad (2)$$

A length of the compression-type textured strand before rapid tension application may be an initial length ($d_0$), wherein a converted diameter of the strand may be $R_0$, and a BV of the strand may be $BV_0$. The length of the strand when the strand is pulled out until the texture is fully stretched without elongation of filaments within the strand is defined as the tensile length ($d_1$). Pulling a strand at high speed to the tensile length ($d_1$) and releasing the strand after is defined as rapid tension application (pull-out, PO). A rate of rapid tension application (PO) for measuring the SVD ($SVD_2$), BV ($BV_2$), and cross-sectional area ($S_2$) may be set as 150 mm/seconds. A length of the strand after the strand has undergone rapid tension application (PO) and been left for one day under conditions of 40° C. and a relative humidity (RH) of 60% may be defined as an extended length ($d_2$) of the strand, wherein a converted diameter of the strand may be $R_2$, and a BV of the strand may be $BV_2$.

An increase ratio of SVD ($SVD_{ratio}$) of the strand after the rapid tension application (PO) may be represented by Equation (3) and may be in a range of 1.5 to 8:

$$SVD_{ratio}=SVD_2/SVD_0=BV_2/BV_0 \quad (3)$$

wherein, in Equation (3), $SVD_0$ and $SVD_2$ respectively indicate SVD before and after rapid tension application to the strand, and $BV_0$ and $BV_2$ respectively indicate BV before and after rapid tension application to the strand.

The compression-type textured strand according to an embodiment of the present invention may exhibit an increase in BV caused by extension in the direction of an X (length direction) axis and at least one of the perpendicular directions of the X (length direction) axis due to rapid tension application to the strand.

After performing the rapid tension application, an increase ratio of area ($S_{ratio}$) of a vertical cross-section of the strand, represented by Equation (4), may be 1.5 times to 7 times:

$$S_{ratio}=S_2/S_0 \quad (4)$$

wherein, in Equation (4), $S_0$ and $S_2$ respectively represent cross-sectional areas of the strand before and after the rapid tension application.

The cross-section of the strand may be extended by the rapid tension application (PO), and the area may be enlarged while maintaining the original shape of the cross-section before the rapid tension application (PO). In addition, even when the volume is extended by the rapid tension application (PO), the macro-textures of the appearance such as curls and waves and micro-textures of the strand may be maintained.

To objectively evaluate characteristics of various strands, a rate of rapid tension application (PO) for measuring the SVD ($SVD_2$), BV ($BV_2$), and cross-sectional area ($S_2$) may be set as 150 mm/seconds. However, in the case of using the compression-type strand of textured filament for wigs according to the present invention, the strand may be extended by applying rapid tension within an appropriate range up to the tensile length ($d_1$) to the compressed strand. For example, rapid tension may be applied at a rate ranging from 100 mm/sec to 500 mm/sec. Rapid tension may be applied to the strand using an apparatus, or rapid tension may be applied to the strand using a hand.

Bulk Volume (BV)

As described above, in addition to micro-textured windings formed in the texturing unit macro-textures such as waves may be formed by compression and rotation of the stacking direction as the strand is compressed in the compression accumulation unit during the manufacturing process of the compression-type textured strand.

During the manufacturing process, textured filaments in the strand may be compressed in the strand length direction, and the textured filaments may become highly dense in a state of close contact (texture and texture may be intertwined to reduce porosity and be adhered to each other). By applying rapid tension (PO) to the strand, the waves of macro-appearance neatly stacked in a compressed state of the strand may be disproportionately disturbed from a central axis of the appearance (a length direction), and at the same time, the micro-windings stacked in a closely contacted state may also be disproportionately disturbed leading to enlarge porosity, all of which may contribute to an increase in the BV of the strand by extending the cross-section of the strand and extending the length of the strand. As the closely contacted state of the filaments is released by rapid tension application (PO), three-dimensional irregular textures in an unspecified (random) direction is irregularly extended, thus contributing to simultaneous extension of the cross-section and the length of the strand. While not wishing to be bound by a theory, here, the BV may be maximized due to a greater contribution by the increase in the cross-section (thickness) than by the increase in the length of the strand, and the increase is considered to be due to the three-dimensional extension of the texture. Therefore, the compression-type textured strand according to the current embodiment basically has an irregular three-dimensional texture in an unspecified (random) direction and is in a highly dense state by the compression process. Thus, after rapid tension application (PO), BV may be effectively increased.

When the flexural strength or elasticity of the wig filament is weak, the wig filament may yield during rapid tension application (PO), causing the waves to loosen and the appearance thickness of the strand to become smaller. Or, when the flexural strength or elasticity of the wig filament is weak, though the BV of the outline of the strand may increase, its appearance may not be uniform and irregular, and thus, the aesthetic value as a wig product may be deteriorated. When the flexural strength or elasticity of the wig filament is too high, the wig filament may not comply to rapid tension application (PO) and may return to the original wave state, which may not contribute to an increase in volume of the strand. The flexural strength and elasticity of wig filament may be adjusted to some extent during the spin draw process, but the factors that actually cause a big difference in the parameters are physical strength and elasticity of the wig filament material.

Compressive Strain Rate

In an actual logistics process, the compressive strain rate may be measured to determine whether the compressed strand is deformed due to compression by load or pressure in the vertical direction of the length of the compressed strand in a packing box. A method of measuring a compressive strain rate of a strand will be described with reference to FIGS. 4 and 5.

Figure 4:
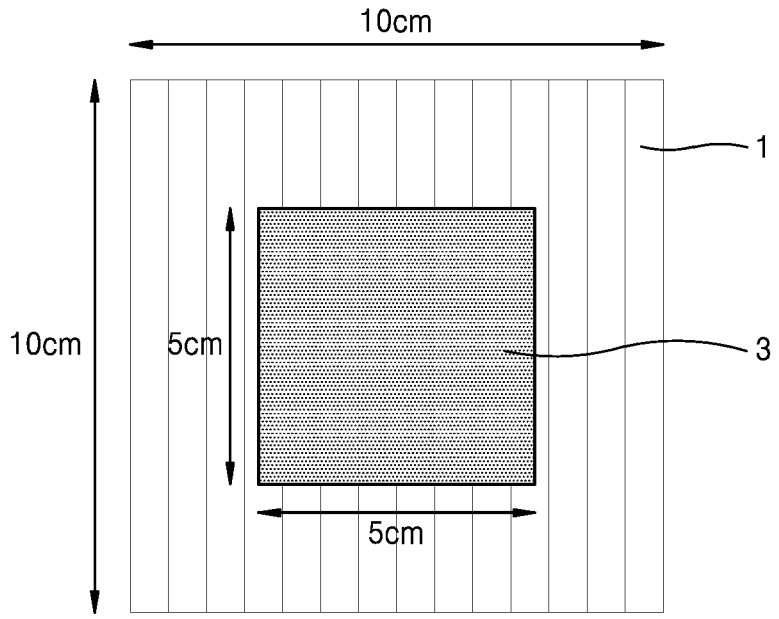
FIGS. 4 and 5 are diagrams for describing a method of measuring a compression rate of a strand.
Figure 5:
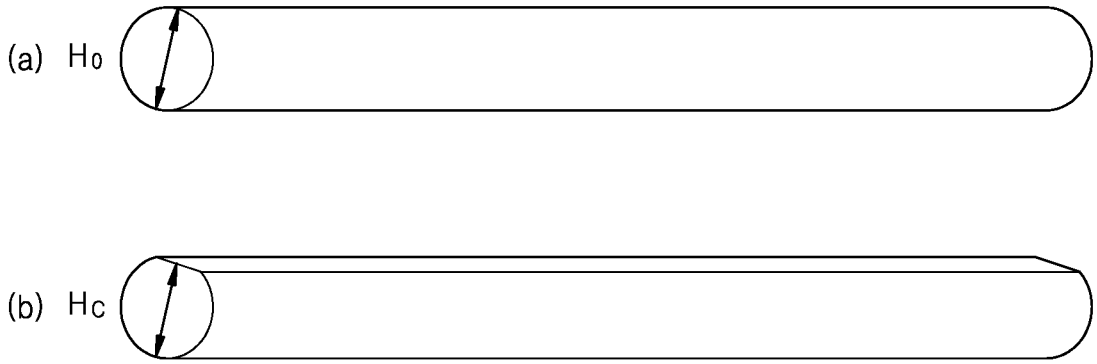

Referring to FIG. 4, 10 cm-long compressed strands may be arranged side by side in an area of 10 cm×10 cm. The diameter ($H_0$) of the arranged compressed strand may be measured. A 5 cm×5 cm weight plate may be placed on arrangement of the compressed strands and may stand for 1 hour at 60° C. and at an RH of 60%, and then the diameter ($H_C$) of the compressed strand may be measured. Here, the weight plate may have a weight that may apply the same pressure as the pressure applied by a packing box actually filled with the compressed strand. For example, when 5 kg of compressed strands are filled in a packing box of 70 cm (width)×40 cm (length)×25 cm (height), a pressure of 5,000 g/(40×70) $cm^2$=1.79 g/$cm^2$ may be applied by the packing box. To this end, the weight plate may have a weight of 1.79 g/$cm^2$×25 $cm^2$=44.6 g.

The compressive strain rate (CR), which is the value of deformation due to compression by load of the strands in a packing box by the foregoing method, is expressed by the following Equation (5):

$$\text{Compressive strain rate (CR)}=((H_0-H_c)/H_0)\times 100(\%) \quad (5)$$

The compressive strain rate of the compressed strand according to one embodiment may be less than 10%, for example, less than 7%, or for example, less than 5%. When the compressive strain rate of the compressed strands is higher than 10%, it may be difficult to increase the BV while maintaining the original shape after appropriate rapid tension application (PO).

The compressive stain rate is also affected by the flexural strength of a wig filament material, unlike SVD, which indicates pure density. Flexural strength is a property that also affects stability of shape after rapid tension application (PO). In the case of strands having the same SVD, as the compressive strain rate is lower, the stability of shape (SOS) may be greater, after rapid tension application (PO).

Rapid Tension Application (PO) and Measurement of BV

After rapid tension application (PO), BV may be measured using a tensile tester or a random breaker (rupture tester). The random breaker is an apparatus that applies rapid tension. In the Examples of the present invention, a random breaker (Model No. PREPEN-N, Manufacturer: FINE TECHNICS.CO., LTD.) was used to measure an increase ratio of SVD ($SVD_{ratio}$) of the compression-type textured strand after the rapid tension application (PO). The random breaker is a device that applies rapid tensile tension to a strand using a stroke of cylinders to which pneumatic pressure of 6 kgf/cm$^2$ is applied by a regulator. The specifications of the random breaker are as follows.

1. Force to press filaments by a pneumatic pressure cylinder (F1):

Force to press a jaw in a vertical direction of a length of filaments

1) Cylinder specification (Spec.): diameter (D)=63 mm, moving distance=50 mm
2) pneumatic pressure: 6 Kgf/cm$^2$
3) $F1=(3.14\times6.3^2/4)\times6=187$ Kgf 2. Tensile force on filaments by a pneumatic pressure cylinder (F2(max)):

Force to apply rapid tension in both directions of a length of filaments by two jaws 1) Cylinder specification (Spec.): diameter (D)=100 mm, maximum moving distance=150 mm
2) pneumatic pressure: 6 Kgf/cm$^2$
3) $F2(max)=(3.14\times10^2/4)\times6=471$ Kgf 3. Moving distance (D) of each jaw in rapid tension application machine: jaws are moved as much as the distance between each jaw corresponds to an average length of filaments in sample strand in a straightened state in which all textures of the filaments are straightened.
4. Moving velocity (V) of each jaw in rapid tension application machine=150 mm/sec In the random breaker (random breaker) (PREPEN, FINETECHNICS CO., LTD.), one textured strand was laid straight and flat on the random breaker and clamped at both end by both interlocking parts (jaws), and the initial distance between the interlocking parts, that is, the initial length of the strand ($d_0$) was set as 100 mm. Thereafter, a tensile test was performed in which the two interlocking parts were rapidly pulled in opposite directions at a tensile speed (PO speed) of 150 mm/sec to evaluate an increase ratio of BV or an increase ratio of SVD ($SVD_{ratio}$). For the reliability of experimental data, an average value of each 10 repetitions was obtained ("PO application method A"). Here, because the size and degree of micro-textures and the state of macro-textures such as waves are different for each type of strand to be measured, the initial length of the sample strand and the tensile length after rapid tension application (PO), i.e., rapid tension application (PO) distance (PO distance), was defined as follows.

The rapid tension application (PO) distance (PO distance) was defined as the length of a strand when the strand is pulled in both length directions until filaments were closest in a vertical direction of length without elongation of the filaments in the strand. The rapid tension application (PO) distance is identical to the tensile length ($d_1$). When the strand is pulled to the tensile length thereof ($d_1$), windings of the texture are straightened, and the space caused by the windings is reduced such that the filaments are closest with each other, that is, in the vertical direction of the length.

Because the PO distance may increase in proportion to the length of a sample strand, first, the length of the sample strand may be fixed to 100 mm for accurate comparison between strands. The initial distance between the interlocking parts (jaws) on both sides of the random breaker may be adjusted to be identical to the length ($d_0$) of the sample strand of 100 mm. For objective accuracy in measuring the PO distance or tensile length ($d_1$) of the 100 mm strand sample, a load weight corresponding to 500 times the weight of 1 meter of the sample strand (5,000 times the weight of the 100 mm sample) is applied. For example, a load weight of 250 g was added to 100 mm of a 5 g/10 m strand sample, and the length of the strand sample was measured repeatedly 10 times by hanging as much as possible, and the PO distance, i.e., the tensile length ($d_1$), was obtained as the average value. ("PO distance measurement method A"="tensile length ($d_1$) measurement method A")

300 mm of a strand was taken and marked with white paint at 100 mm positions from both ends. Each 100 mm of both ends of the strand were held with both hands, and a slow tension of 10 mm/sec was applied in both length directions to filaments in the 100 mm strand remaining in the center, such that the filaments were closest in a vertical direction of length within a limit in which filament elongation cannot occur. Here, the finally reached length by stretching the remaining 100 mm of the strand was measured ("PO distance measurement method B"="tensile length ($d_1$) measurement method B"). The value of tensile length ($d_1$) measured using the hands was identical to the value of tensile length (d) measured by the aforementioned load weight.

The moving distance of both interlocking parts was set such that the strand was stretched up to the tensile length ($d_1$) of the strand determined as described above, the strand was pulled at a speed of 150 mm/sec, and the strand was released from the interlocking part immediately after 5 seconds. After that, the strand subjected to the rapid tension application (PO) was left again under conditions of 40° C. and an RH of 60% for one day, and then, the length and the volume of the strand were defined as an extended length ($d_2$) and an expanded bulk volume ($BV_2$), respectively.

The length change ratio of the strand by rapid tension application (PO) may be expressed by Equation (6):

$$d_{ratio}=d_2/d_0 \tag{6}$$

$d_0$ represents a length of a strand before rapid tension application (an initial length), and $d_2$ represents a length of the strand after the rapid tension application.

An increase ratio of BV of the strand ($BV_{ratio}$) may be expressed by Equation (7):

$$BV_{ratio}=BV_2/BV_0 \tag{7}$$

$BV_0$ represents an initial BV of a strand before rapid tension application, and $BV_2$ represents an extended BV (extended volume) of the strand after rapid tension application.

Figure 6:
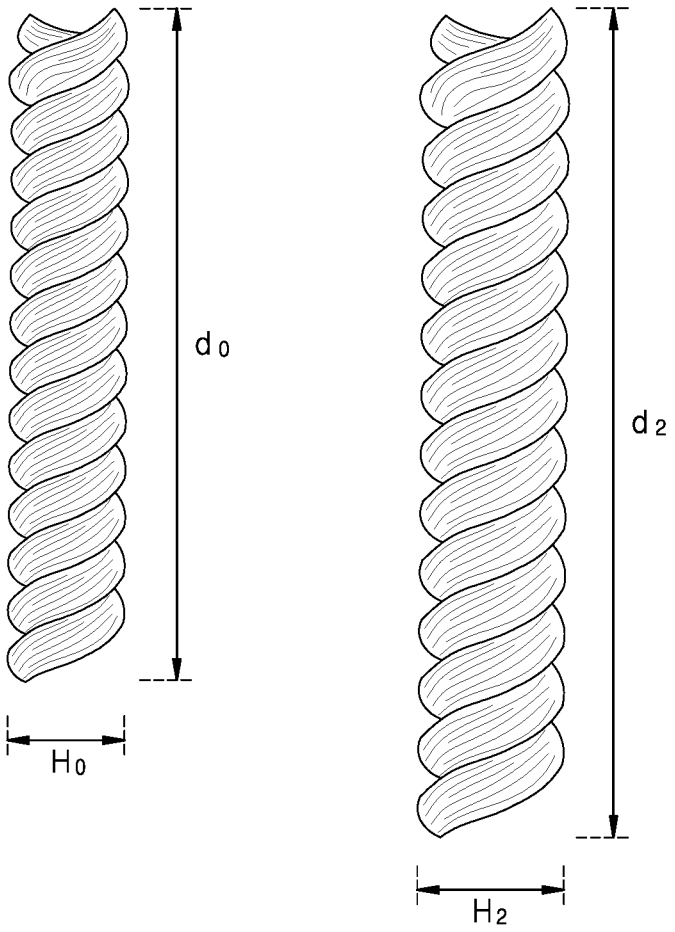
FIG. 6 is a conceptual view showing that an initial length ($d_0$) and an initial diameter ($H_0$) of the compressed strand before rapid tension application (pull-out, PO) are respectively increased to an extended length ($d_2$) and an extended diameter ($H_2$) by the rapid tension application (PO).

FIG. 6 is a conceptual view showing that an initial length ($d_0$) and an initial diameter ($H_0$) of the compressed strand before rapid tension application (PO) are respectively increased to an extended length ($d_2$) and an extended diameter ($H_2$) by the rapid tension application (PO). The initial BV ($BV_0$) and the extended BV ($BV_2$) may respectively be proportional to $\pi H_0^2 d_0/4$ and $\pi H_2^2 d_2/4$.

Optionally, an increase ratio of BV of a strand may be measured by applying rapid tension to the compressed compression-type textured strand with both hands instead of using a random breaker. In such a simple measurement method, the compressed compression-type textured strand may be held with both hands, and tension may be applied to filaments in the strand in opposite length directions such that the filaments in the strand are in closest contact with each other, that is, in the vertical length direction. Then the filaments may be immediately released and left for one day under conditions of 40° C. and at an RH of 60%, followed by measurement of the length change rate and an increase ratio of BV of the strand ("PO application method B"). However, here, the filaments may be stretched within a limit where the filaments are not elongated or broken by the tension of both hands. When excessive tension is applied to thereby cause a stage of elongation and breakage of the filament, aesthetic values of the textured strand may be damaged. This does not meet the purpose of actual use. The length change ratio and the increase ratio of BV of the strand measured by the simple measurement method were almost identical to those measured using the PREPEN random breaker.

Stability of Shape (SOS) Evaluation

The type of polymer of the wig filament for texturing is not particularly limited, but the polymer may have properties that may maintain the shape thereof after the high-density textured strand becomes bulky due to rapid tension application (PO). The SOS and texture deformation after rapid tension application (PO) may be evaluated as a shape strain rate. The shape strain rate of a strand refers to evaluation of the SOS when a user (wearer) is wearing the strand on their head. The shape strain rate of a strand may be evaluated as follows.

After rapid tension application (PO), a compression-type textured strand may be cut to 24 inches long, and a load weight of 0.0001 gf/filament (0.024 g based on 240F*60de) may be added and stabilized for 10 seconds. After that, an initial length ($L_1$) may be determined by measuring the length of the strand. Alternatively the initial length ($L_1$) may be determined by measuring the length of the strand that is stretched downward by the weight of strand itself instead of adding load weight. Then, a load weight of 0.005-0.01 gf/filament (1.2 g to 2.4 g based on 240F*60de) may be added to the strand and maintained for 1 minute. Then, a load weight of 0.0001 gf/filament may be added to the strand and stabilized for 10 seconds to determine a deformed length ($L_2$) by measuring the length of the strand (shape strain rate measurement method A).

The shape strain rate of the strand may be calculated from the initial length ($L_1$) and the deformed length ($L_2$) of the strand according to Equation (8):

$$\text{Shape strain rate}=(L_2-L_1)/L_2\times 100 \quad (8)$$

It is desirable from the viewpoint of aesthetics and durability that the shape strain rate of the strand may be less than 50%, for example less than 30%, for example less than 15%, or for example, less than 10%.

The shape strain rate of a strand may also be measured by the following simple measurement method. In a simple measurement method, after rapid tension application (PO), the strand immediately after being hung vertically under conditions of 40° C. and an RH of 60% may be cut to a length of 24 inches to be set as an initial length ($L_1$). In addition, after the rapid tension application (PO), the strand having a length ($L_1$) of 24 inches may be hung vertically under conditions of 40° C. and an RH of 60% for 24 hours to measure the length that may be set as a deformed length ($L_2$). Using Equation (8), the shape strain rate of the strand may be calculated from the initial length ($L_1$) and the deformed length ($L_2$) (shape strain rate measurement method B). In the simple measurement method, It is desirable from the viewpoint of aesthetics and durability that the shape strain rate of the strand may be 50% or lower, for example 30% or lower, for example 15% or lower, or for example, 10% or lower.

A production process of wig filament may also have some effect in maintaining physical strength and elasticity such that the strand may have a shape strain rate within the range above, but the flexural strength and elasticity of the wig filament has a great effect. Unlike general fiber yarn, wig filament may have a denier range from 10 to 180, or more specifically, 30 to 60. Thus, the range of elongation or heat setting of the wig filament is not wide. Filaments for fibers that require physical properties such as weather resistance and washing resistance may be elongated up to 5 to 8 times for maximum rigidity, thereby increasing tensile strength and flexural strength to some extent. However, most wig filaments may undergo a process that may not induce complete orientation and crystallization of polymers as an elongation range is 2 to 4 times during the manufacturing process. Because a wig strand may not have to have a high tensile strength, the wig strand may undergo an elongation process to an extent such that entanglement does not occur. Rather, excessive elongation may have a side effect of not improving hand feeling or skin feeling of a wig filament. In addition, when a denier (thickness) of a wig filament is increased excessively, in addition to the problem of rough hand feeling, it may be difficult to help maintain the stability of shape of the strand after rapid tension application (PO). This is because, when the denier of the filament increases, the weight (load) per filament may increase, such that a greater downward load may be applied upon wearing.

Therefore, a flexural strength of a strand required to maintain style stability after rapid tension application (PO) may be highly dependent on the physical strength of the wig filament material (polymer).

Flexural Strength and Flexural Modulus

A denier of a wig filament and a flexural strength and a flexural modulus of a wig filament material are properties that allow micro-textures and macro-textures or waves of a strand to be aesthetic in terms of a wig product. When the flexural strength and the flexural modulus of the wig filament material are too weak, style stability may not be secured beyond an appropriate range of a shape strain rate of the strand. When the flexural strength and the flexural modulus of the wig filament material are too strong, the volume-up by rapid tension application (PO) may not be sufficiently achieved, and also, the hand feeling may be rough, and thus, consumers (wearers) with sensitive skin may not prefer the wig filament.

A denier may be in a range of 10 to 180 depending on the weight of the wig filament material in a diameter range of 30 μm to 200 μm (outer diameter thickness when converted assuming that a cross-section is circular), which is similar to true hair. For micro-textures and macro-textures or waves of strands having wig filaments in such a denier range to be aesthetic upon rapid tension application (PO) the flexural strength of the filament (based on ASTM D790) may be in a range of about 300 kgf/cm$^2$ to 1,300 kgf/cm$^2$ (4,250 psi to 18,500 psi), or for example, about 600 kgf/cm$^2$ to 1,200 kgf/cm$^2$ (8,500 psi to 17,100 psi), and the flexural modulus of the filament may be in a range of 13,000 kgf/cm$^2$ to 36,000 kgf/cm$^2$ (184,900 psi to 512,050 psi), or for example, 20,000 kgf/cm$^2$ to 29,000 kgf/cm$^2$ (284,450 psi to 412,480 psi). The flexural strength and the flexural modulus of a wig filament material may be measured by melting a wig filament to produce a specimen specified in ASTM D790 from a molten polymer and using the specified method.

The resistance to bending of various materials such as plastics, ceramics, and rubber samples is called flexural strength. Specimens of physical property analysis and customized analysis of flexural strength may be manufactured through injection molding, and flexural strength and flexural modulus may be evaluated using a universal testing machine (UTM).

Cross-Sectional Shape of Strand

The compression-type textured strand after rapid tension application (PO) may have a circular shape, oval shape, polygonal shape, or a combined shape that is a combination thereof. The polygonal shape may be, for example, an n-sided polygonal shape in which n is 3 or more or a combined shape that is a combination thereof.

One of the recent trends in the art is seeking differentiation by using polygons rather than circles as a cross-section shape. When the cross-section is a polygonal shape or a combined shape, as compared with a circular shape, end consumers (wearers) may find these styles very useful to express individuality.

Bulky Deformability

During the logistics of the compression-type textured strand, binding of texture between filaments (entanglement of textures) may occur due to compression. However, a deformed part induced by such binding may be restored to the original shape as the binding is unfastened by applying (PO) rapid tension to the strand.

According to an embodiment, a bulky state may be used partly in a length direction of the strand by applying rapid tension (PO) only to portions in the length direction of the compression-type textured strand.

That is, by utilizing such bulky variation of the compression-type textured strand according to an embodiment, wig manufacturers may produce various bulky models and release the various bulky models in the market but also may provide the compression-type textured strand itself to an end consumer (wearer). In this case, an end consumer (wearer) may use a strand in a compressed state, use the strand with bulky transformation in parts or all of the strand, or change the style of the strand after using the strand for a certain period of time according to preferences.

(Types of High-Density Compression-Type Textured Strand)

The increase ratio of BV or increase ratio of SVD ($SVD_{ratio}$) of the compression-type textured strand according to an embodiment by rapid tension application (PO) may be 1.5 times to 15 times, for example, 4 times to 10 times, or for example, 5 times to 8 times.

Figure 7:
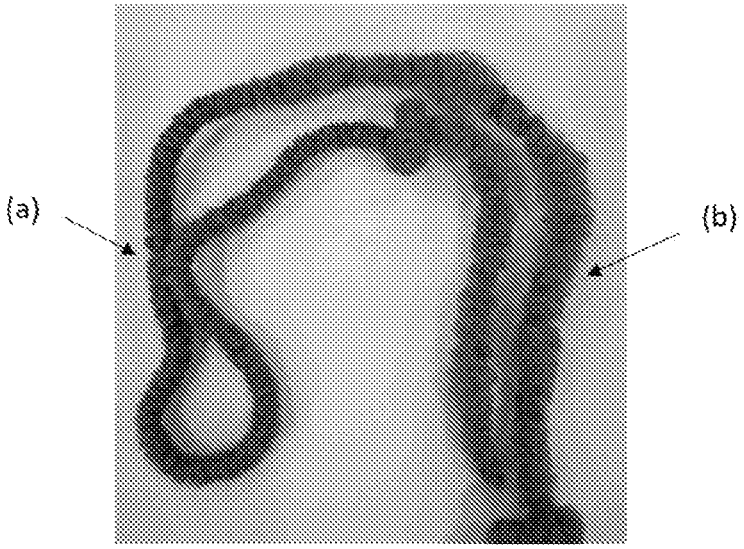
FIG. 7 is an image of a compression-type LOC braid strand extending into a lightweight bulk LOC braid by rapid tension application.

The compression-type textured strand according to an embodiment may be a high-density compression-type LOC braid having an SVD in a range of 2 to 25 or 3 to 15 before rapid tension application (PO), and after the rapid tension application (PO), the compression-type textured strand may be transformed to an extended lightweight bulky LOC braid having an increase ratio of BV or SVD ($SVD_{ratio}$) in a range of 1.5 to 6 times (see FIG. 7). In FIG. 7, portion (a) is a compressed LOC braid portion, and portion (b) is a lightweight bulky LOC braid portion which is uncompressed by rapid tension application (PO).

Figure 8:
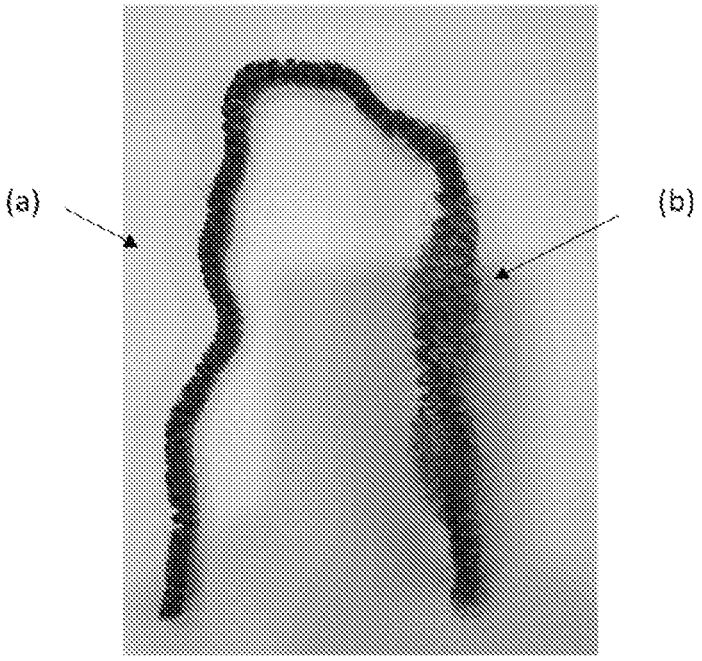
FIG. 8 is an image of a compression-type LOC braid strand extending into a lightweight Marley braid by rapid tension application.

The compression-type textured strand according to an embodiment may be a high-density compression-type LOC braid having an SVD in a range of 2 to 25 or 5 to 20 before rapid tension application (PO), and after the rapid tension application (PO), the compression-type textured strand may be transformed to a lightweight Marley braid having macro-wave textures and micro-flexural textures at the same time and having an increase ratio of BV or SVD ($SVD_{ratio}$) in a range of 2 to 8 times (see FIG. 8). In FIG. 8, portion (a) is a compressed LOC braid portion, and portion (b) is a lightweight Marley braid portion which is uncompressed by rapid tension application (PO).

Figure 9:
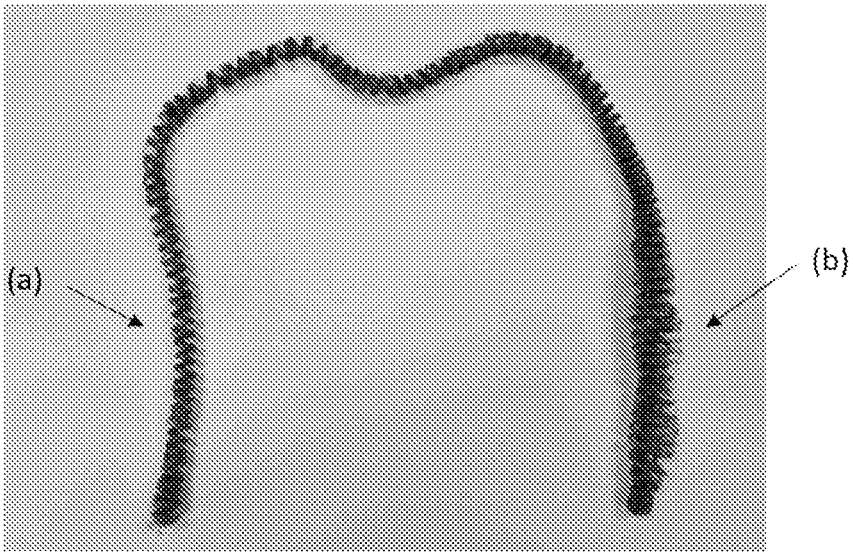
FIG. 9 is an image of a compression-type curly braid strand extending into a lightweight curly braid by rapid tension application (PO).

The compression-type textured strand according to an embodiment may be a high-density compression-type curly braid having an SVD in a range of 5 to 30 or 10 to 30 before rapid tension application (PO), and after the rapid tension application (PO), the compression-type textured strand may be transformed to an extended lightweight curly braid having an increase ratio of BV or SVD ($SVD_{ratio}$) in a range of 2 to 8 times (see FIG. 9). In FIG. 9, portion (a) is a compressed curly braid portion, and portion (b) is a lightweight curly braid portion which is uncompressed by rapid tension application (PO).

Figure 10:
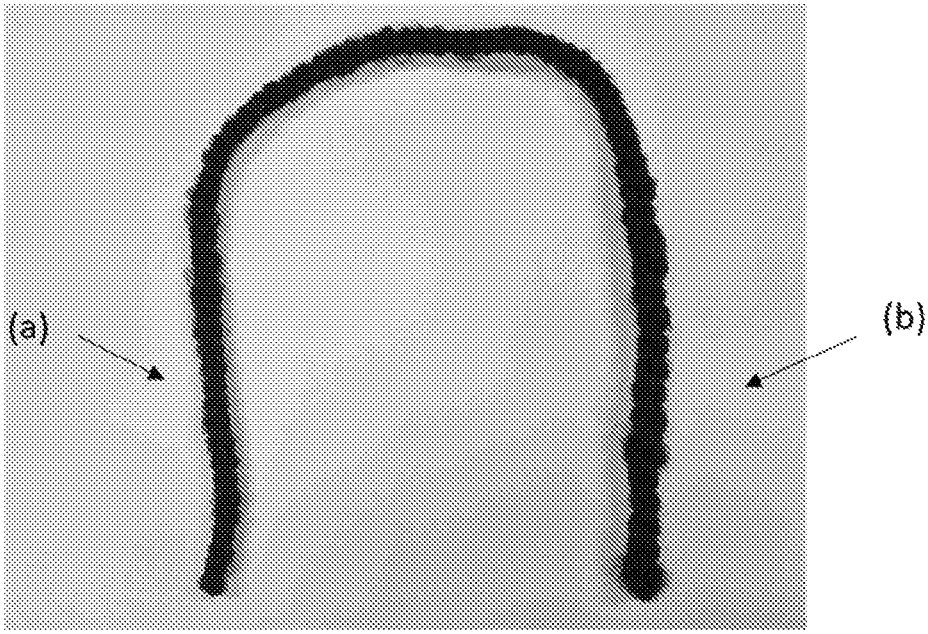
FIG. 10 is an image of a compression-type twist braid strand extending into a lightweight twist braid by rapid tension application.

The compression-type textured strand according to an embodiment may be a twist braid (cross twisted filament-bundle) type having an SVD in a range of 3 to 10 before rapid tension application (PO), and after the rapid tension application (PO), the compression-type textured strand may be transformed to an extended lightweight twist braid having an increase ratio of SVD ($SVD_{ratio}$) in a range of 1.5 to 4 times (see FIG. 10). In FIG. 10, portion (a) is a compressed twist braid portion, and portion (b) is a lightweight twist braid portion which is uncompressed by rapid tension application (PO).

Figure 11:
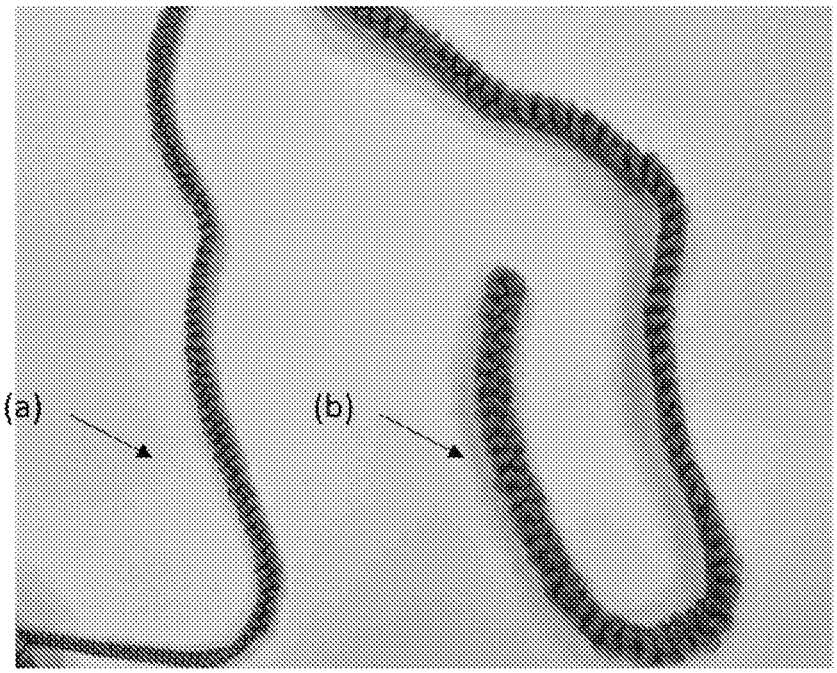
FIG. 11 is an image of a compression-type box braid strand extending into a lightweight box braid by rapid tension application.

The compression-type textured strand according to an embodiment may be a high-density compression-type box braid (braided filament-bundle) type having an SVD in a range of 3 to 10 before rapid tension application (PO), and after the rapid tension application (PO), the compression-type textured strand may be transformed to an extended lightweight box braid having an increase ratio of SVD ($SVD_{ratio}$) in a range of 1.5 to 4 times (see FIG. 11). In FIG. 11, portion (a) is a compressed box braid portion, and portion (b) is a lightweight box braid portion which is uncompressed by rapid tension application (PO).

Figure 12:
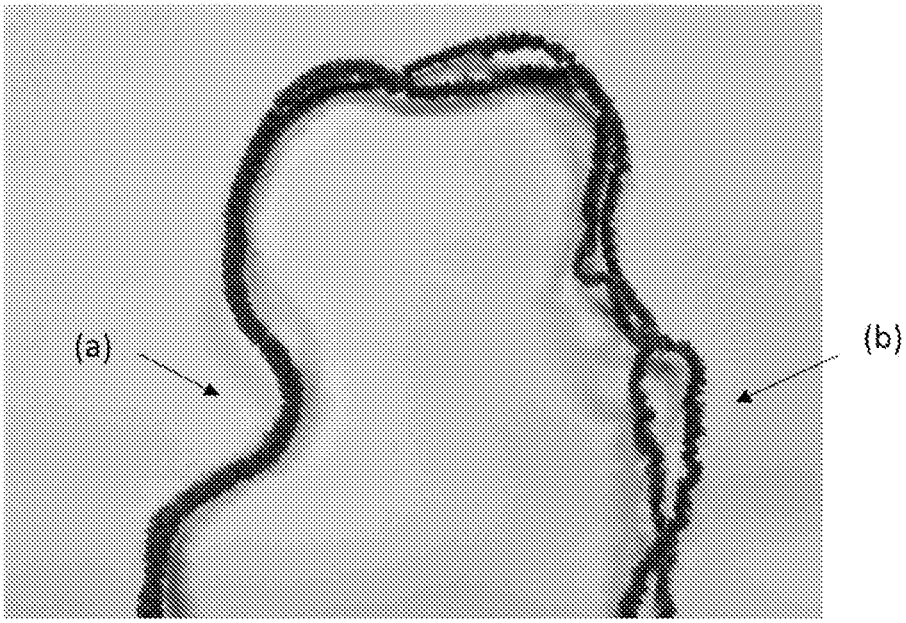
FIG. 12 is an image of a compression-type TM bundle that may be separated by thread.
Figure 13:
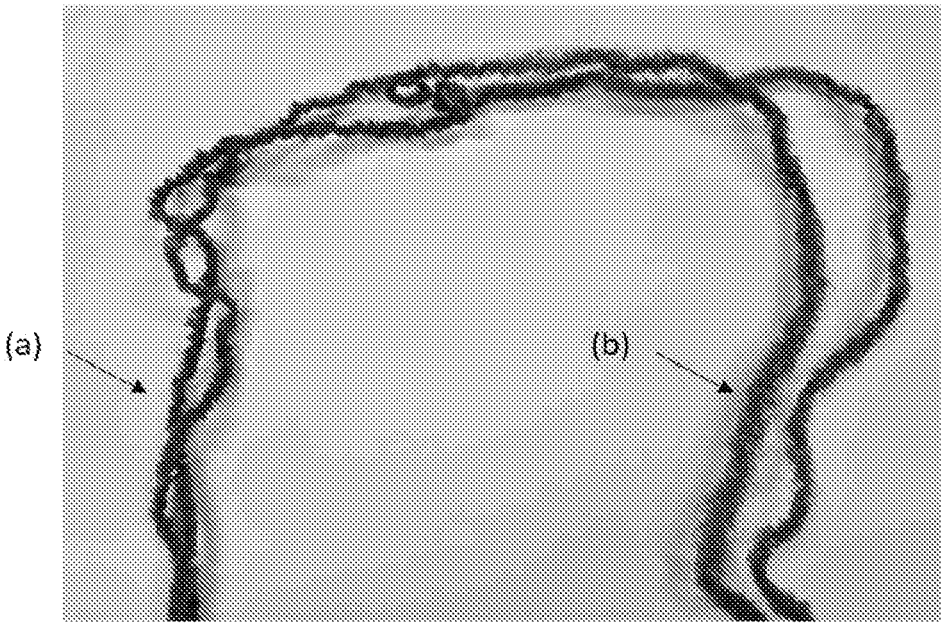
FIG. 13 is an image of a compression-type distorted LOC braid strand extending into a lightweight bulk distorted LOC braid by rapid tension application.

The compression-type textured strand according to an embodiment may include one or more of a rotational-twisted or spiral-twisted filament-bundle, and the strand may be separated into as many as a number of the rotational-twisted or spiral-twisted bundles, and become a compressed modified LOC braid (see FIG. 12). In FIG. 12, portion (a) is a compressed LOC braid portion before separation of bundles, and portion (b) is a compressed modified LOC braid portion of which rotational-twisted or spiral-twisted bundles are separated. The SVD of each separated bundle before rapid tension application (PO) may be in a range of 3 to 10. An increase ratio of SVD ($SVD_{ratio}$) of each of the rotational-twisted or spiral-twisted bundles after the rapid tension application (PO) may become 1.5 to 6, and each of the rotational-twisted or spiral-twisted bundles may be converted into a lightweight modified LOC braid in which irregular waves may be expressed (see FIG. 13). In FIG. 13, portion (a) is a separated compressed modified LOC braid portion, and portion (b) is a lightweight modified LOC braid portion which is uncompressed by rapid tension application (PO).

The compression-type textured strand according to an embodiment, by including a bundle of thermally bonded filaments, may be converted into a lightweight bulky wet-look braid after rapid tension application (PO). The strand may be separated according to the number of bundles. The separated bundles may form a lightweight bulky wetlook braid having irregular waves.

In the compression-type textured strand according to an embodiment, a degree of micro-flexural textures and macro-wave textures or a thickness of the strand may vary according to a location on the strand. As such, a strand having varying micro-flexural textures, macro-wave textures, or thickness may be prepared by adjusting pneumatic pressure, a wig filament supply rate, or a residence time of wig filament in a pipe in texturing, compressing, or cooling in a manufacturing process The compression-type textured strand according to one or more embodiments may have a circular shape, oval shape, polygonal shape, or a combined shape that is a combination thereof. The polygonal shape may be, for example, an n-sided polygonal shape in which n is 3 or more or a combined shape that is a combination thereof.

Figure 14:
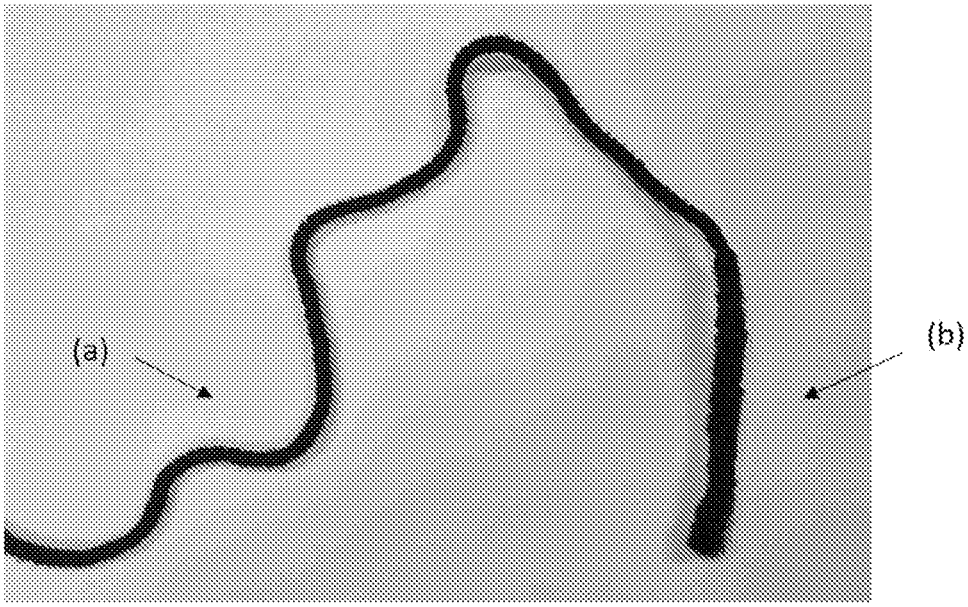
FIG. 14 is an image of a compression-type LOC braid strand extending into a lightweight micro texture braid by rapid tension application.

The compression-type textured strand according to an embodiment may have micro-flexural textures only without external wave textures (see FIG. 14). In FIG. 14, portion (a) is a compressed LOC braid portion, and portion (b) is a lightweight micro-texture braid portion not having macro-wave textures, and only having micro-flexural textures, after rapid tension application (PO).

In the previous manual manufacturing method, a wig filaments were winded around the mold, e.g., a pipe, as a core, and by removing the mold, curls were formed with a hollow core. In this case, the shape may be similar to a shape of hair when waves are made using a curling iron. On the other hand, the compression-type textured strand according to the present invention may have a shape filled with wig filaments from a core to the outside of the strand both before and after rapid tension application (PO), and thus the compression-type textured strand may be different from the conventional strand having waves with hollow core.

The length of the compression-type textured strand according to an embodiment may depend on the length of the supplied wig filament. When the length of the wig filament is long, the length of the compression-type textured strand prepared therefrom may also be increased. A compression-type textured strand before cutting the length to be applicable to a wig may be called a compression-type continuous textured strand. The compression-type continuous textured strand may have a length of 0.5 m or longer, or for example, 1 m or longer.

The compression-type textured strand according to an embodiment may be cut from the compression-type continuous strand and may have various lengths, for example, 30 cm or 40 cm.

MODE OF DISCLOSURE (Preparation Example of Compression-Type Textured Strand and Lightweight Braid Wig Using the Same)

In more detail, a manufacturing process of the present invention will be described with a Preparation Example of a high-density compression-type textured strand that is transformed into a lightweight Marley braid after rapid tension application (PO).

1) A PET/PBT (at a weight ratio of 90:10) mixed material wig filament was spun with a 180-hole Y-shaped nozzle at an extruder temperature of 240° C. to 280° C. in a spin-draw-yarn facility. After 4.8 times elongation in an elongation unit consisting of 8 stages of Godet Roll, heat setting at 180° C. was performed to manufacture wig filament having a total denier of 9,000 d/180f at a winding speed of 200 meters per minute (MPM). The manufactured wig filament was continuously supplied to a filament supply unit.
2) For texturing, texturing the wig filament bundle was performed by turbulent flow with pneumatic pressure of 6.5 kgf/cm$^2$ heated to 80° C., 10° C. higher than the glass transition temperature (Tg) of PET/PBT of 70° C., and the resulting wig filament bundle was supplied to a compression unit to compress the textured filament while maintaining a residence time in the compression unit pipe for 1 minute.
3) The high-density textured strand was set by cooling in a cooling unit while circulating cooling water at 4° C. at a flow rate of 3,000 cm$^3$/min.
4) The compression-type textured strand, which had been set for cooling, was discharged to the outside by the discharge pressure, and was stacked and packaged in a packing box.

The thus-produced compression-type textured strand had an SVD of 8.5 and a compression rate (CR) of 8%. Based on "PO application method A", after rapid tension application (PO) at a speed of 150 cm/sec, the increase ratio of BV or SVD ($SVD_{ratio}$) of the strand was 6 times, and as the volume was increased, the strand became a lightweight Marley braid. In addition, the shape strain rate was 4%, the flexural strength was 900 kgf/cm$^2$, and the flexural modulus was 24,000 Kgf/cm$^2$. By using 100 g of the lightweight Marley braid, a bulky "braid style" wig was prepared with a head skin coverage volume (CV) of 4,800 cm$^3$.

EXAMPLES

Example 1

Preparation of Polyester Filaments

1) A polyester resin chip having an intrinsic viscosity of 0.65 was dried in a vacuum dryer at 80° C. for 8 hours, and the resulting product was put into an extruder with a screw diameter of 60 mm equipped with a spinneret with a peanut-shaped cross-sectional structure.
2) The cylinder temperature of the extruder was set at 240° C. and the spinneret temperature at 260° C.
3) Filaments extruded from the extruder were supplied to a 6-stage elongation Godet Roll (GR) through air-cooling quenching in a direct spindraw method. Here, the speed of 1 GR was varied, the draft ratio and quenching (cooling) speed were adjusted, the elongation and relaxation process up to 1 GR and 6 GR were adjusted, and then heat-setting was performed to thereby prepare a polyester filament. Here, 480 filaments of 47 denier (47 denier/filament: 47×480=22,560 de) were supplied to the supply unit by controlling the number of nozzle holes and the number of spinnerets from which the filaments were extruded.

Texturing and Compression of Filaments

4) The direct spun drawn 480 filaments (47 denier/filament: 47×480=22,560 de) were continuously supplied to a pipe with an inner diameter of 8 mm through the filament supply unit without winding. The filaments were textured by supplying hot air at 120° C. and 2 Kgf/cm$^2$ to the pipe.
5) In the compressive accumulation unit, the balance of input and output of filaments was adjusted to compress the textured filaments to be in an LOC braid type in the hot air, and the textured filaments were cooled at 20° C. sufficiently and discharged to prepare a compression-type textured strand of LOC braid-type.

Figure 15:
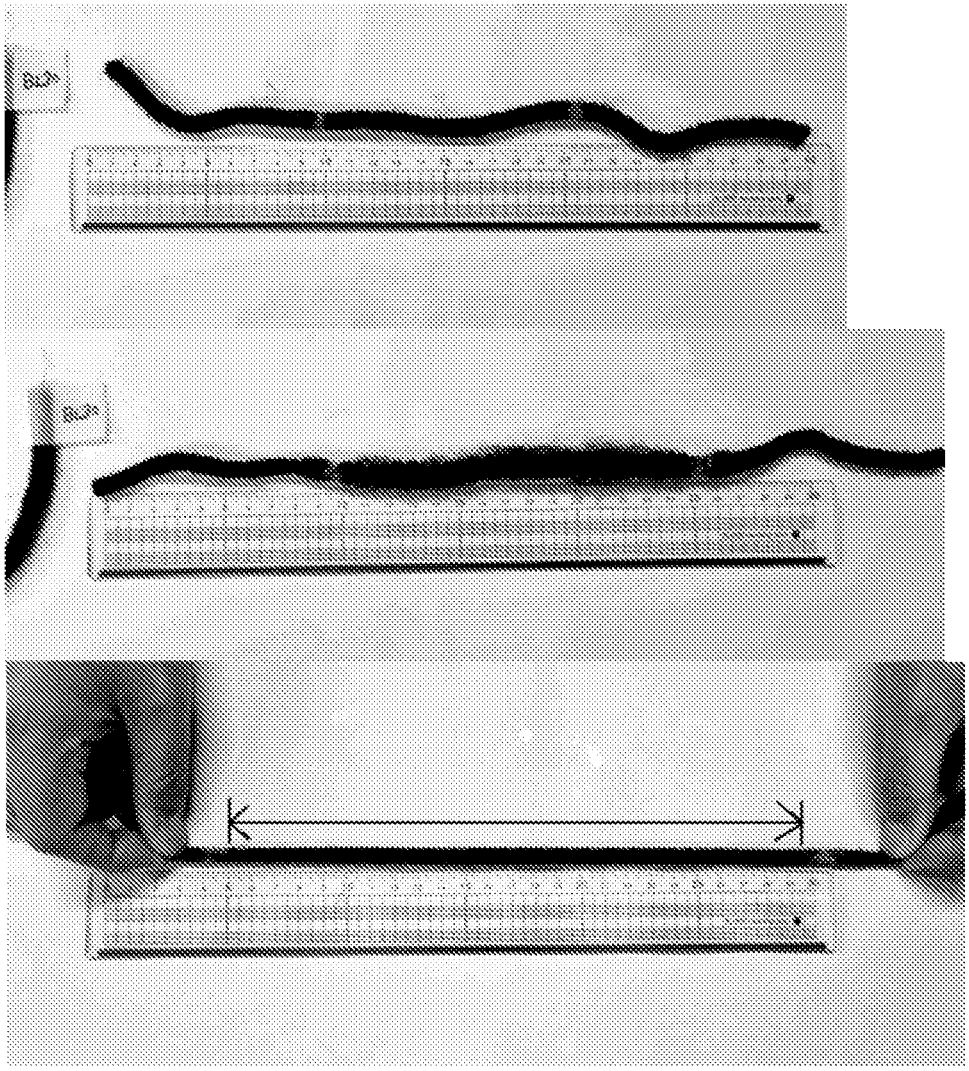
FIG. 15 is an image of a compression-type textured strand prepared in Example 1.

FIG. 15 is an image of the compression-type textured strand prepared in Example 1. In FIG. 15, (a) is a compressed LOC braid strand before rapid tension application (PO), (b) is an extended strand of a lightweight bulky LOC braid after rapid tension application (PO) (by PO application method B), and (c) is a compressed LOC braid strand pulled out to a tensile length ($d_1$) (PO distance) before PO application.

Example 2

Preparation of Polyester Filaments

The polyester filament was prepared in the same manner as in Example 1, except that 900 filaments of 58 denier (58 denier/filament: 58×900=52,200 de) were supplied by controlling the number of nozzle holes and the number of spinnerets.

Texturing and Compression of Filaments

4) The direct spin drawn 900 filaments (58 denier/filament: 58×900=52,200 de) were continuously supplied to a pipe with an inner diameter of 10 mm through the filament supply unit without winding. The filaments were textured by supplying hot air at 160° C. and 6 Kgf/cm$^2$ to the pipe.

4) Then, the textured filaments were compressed, cooled, and discharged by using the same method as in Example 1 to thereby prepare a compression-type textured strand of LOC braid-type.

Example 3

Preparation of Polypropylene Filaments

1) A polypropylene resin chip having a melt index (MI) of 12 was put into an extruder with a screw diameter of 60 mm equipped with a spinneret with a clover shaped cross-sectional structure.

2) The cylinder temperature was set at 180° C. and the spinneret temperature at 190° C. of the extruder.

3) Filaments extruded from the extruder were supplied to a 4-stage elongation Godet Roll through air-cooling quenching in a direct spin draw method. Here, the speed of 1 GR was varied, the draft ratio and quenching (cooling) speed were adjusted, the elongation and relaxation process up to 1 GR and 4 GR were adjusted, and then heat-setting was performed to thereby prepare a polypropylene filament. Here, 480 filaments of 55 denier (55 denier/filament: 55×480=26,400 de) were supplied to the supply unit by controlling the number of nozzle holes and the number of spinnerets from which the filaments were extruded.

Texturing and Compression of Filaments

4) The direct spun drawn 480 filaments (55 denier/filament: 55×480=26,400 de) were continuously supplied to a pipe with an inner diameter of 7 mm through the filament supply unit without winding. The filaments were textured by supplying hot air at 115° C. and 4 Kgf/cm$^2$ to the pipe.

5) Then, the textured filaments were compressed, cooled, and discharged by using the same method as in Example 1 to thereby prepare a compression-type textured strand of LOC braid-type.

Example 4

Preparation of Polyester Filament 480 polyester (PS) filaments of 47 denier (47 denier/filament: 47×480=22,560 de) were prepared by using the same method as in Example 1.

Texturing and Compression of Filaments 4) 35 TM (spiral twist, twist per meter) was applied to the manufactured filaments, and the filaments were supplied to a 2-meter-long hot air tunnel maintained at 120° C.

5) After texturing by thermal shrinkage with free tension of the filaments and predetermined compression in a vertical direction of length by rotational twist (spiral twist), the textured filaments became highly dense and were discharged as a circular cross-section strand having a diameter of 8.5 mm. Accordingly, a compression-type textured strand of LOC braid-type was prepared.

Example 5

Preparation of Polyester Filaments 480 filaments of 47 denier (47 denier/filament: 47×480=22,560 de) were prepared by using the same method as in Example 1.

Texturing and Compression of Filaments

In the compressive accumulation unit, the balance of input and output of filaments was adjusted to compress the filaments textured in hot air, and the textured filaments were cooled at 20° C. sufficiently and discharged to prepare a compression-type textured strand of LOC braid-type that may be transformable to Marley braid type by rapid tension application (PO).

Figure 16:
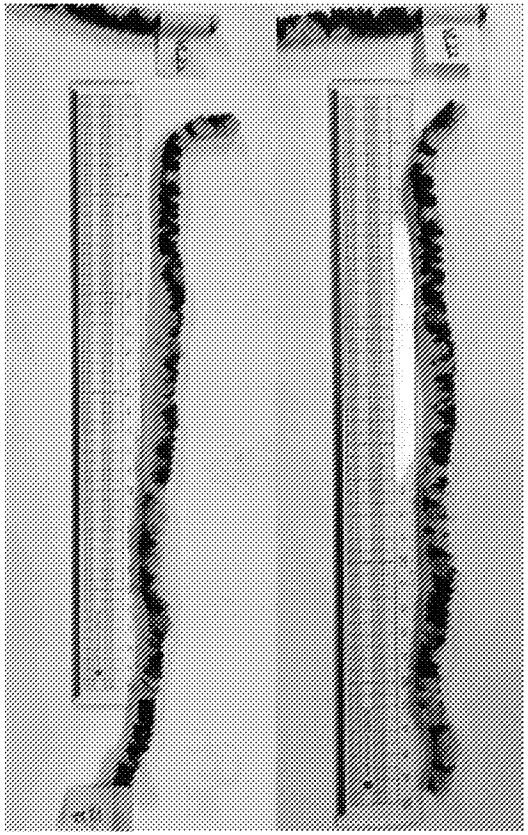
FIG. 16 is an image of a compression-type textured strand prepared in Example 5.

FIG. 16 is an image of a compression-type textured strand prepared in Example 5. In FIG. 16, (a) is a compressed LOC braid strand before rapid tension application (PO), and (b) is an extended strand of a lightweight Marley braid after rapid tension application (PO).

Example 6

Preparation of Polypropylene Filaments 480 polypropylene filaments of 50 denier (50 denier/filament: 50×480=24,000 de) were prepared by using the same method as in Example 3.

Texturing and Compression of Filaments

4) The direct spun drawn 480 polypropylene (PP) filaments (50 denier/filament: 50×480=24,000 de) were continuously supplied to a pipe with an inner diameter of 8 mm through the filament supply unit without winding. The filaments were textured by supplying hot air at 130° C. and 6 Kgf/cm$^2$ to the pipe.

5) A compression-type textured strand of LOC braid-type, which is transformable to a Marley braid type by rapid tension application (PO), was prepared by using the same method as in Example 5.

Example 7

Preparation of Polypropylene (PP) Filaments 480 polypropylene (PP) filaments of 50 denier (50 denier/filament: 50×480=24,000 de) were prepared by using the same method as in Example 3.

Texturing and Compression of Filaments

4) The direct spun drawn 480 polypropylene (PP) filaments (50 denier/filament: 50×480=24,000 de) were continuously supplied to a pipe with an inner diameter of 8 mm through the filament supply unit without winding. The filaments were textured by supplying hot air at 130° C. and 8 Kgf/cm$^2$ to the pipe.

5) A compression-type textured strand of LOC braid-type, which is transformable to a Marley braid type by rapid tension application (PO), was prepared by using the same method as in Example 5.

Example 8

Preparation of Polyester Filaments 900 polyester filaments of 58 denier (58 denier/filament: 58×900=52,200 de) were prepared by using the same method as in Example 2.

Texturing and Compression of Filaments

4) The direct spun drawn 900 filaments (58 denier/filament: 58×900=52,200 de) were continuously supplied to a pipe with an inner diameter of 10 mm through the filament supply unit without winding. The filaments were textured by supplying hot air at 120° C. and 2 Kgf/cm$^2$ to the pipe.
5) In the compressive accumulation unit, the balance of input and output of filaments was adjusted to compress the textured filaments to have a curly braid form in the hot air, and the textured filaments were cooled at 20° C. sufficiently and discharged to prepare a compression-type textured strand of curly braid-type.

Example 9

Preparation of PVC Filaments

Compounding 100 parts by weight of a resin containing 85 weight % of polyvinyl chloride resin (PVC) having a polymerization degree of 1,200 and 15 weight % of chlorinated polyvinyl chloride resin (CPVC) having a chlorination rate of 67% was mixed uniformly with appropriate amounts of processing aids, heat stabilizer, and pigment. This mixture was pelletized in a compounder with a screw diameter of 50 mm. The temperature of each portion of the compounder was 130° C. for a resin supply unit, 190° C. for a compression unit, 200° C. for a melting unit, and 215° C. for a die unit, and a screw rotation speed was 30 rpm.

2) Spinning

Filaments were spun by feeding the pellets prepared in the compounding process to a single-axis spinning machine. The temperature of each portion of the single-axis spinning machine was 170° C. for a resin supply unit, 190° C. for a compression unit, 200° C. for a melting unit, and 215° C. for a head unit. An O-shaped cross-section nozzle was used, and a cross-sectional area of 1 hole of the nozzle was 0.6 mm$^2$.

3) Elongation and Heat Setting

The spun filaments were elongated by a contact heating method by the speed difference of two sets of rollers, and heat setting was performed at a temperature of 115° C. in a heat-setting apparatus connected to the elongation apparatus.

Texturing and Compression of Filaments

4) The direct spun drawn manufactured 480 filaments (50 denier/filament: 50×480=24,000 de) were continuously supplied to a pipe with an inner diameter of 10 mm through the filament supply unit without winding. The filaments were textured by supplying hot air at 105° C. and 5 Kgf/cm$^2$ to the pipe.
5) A compression-type textured strand of curly braid-type was prepared by using the same method as in Example 8.

Figure 17:
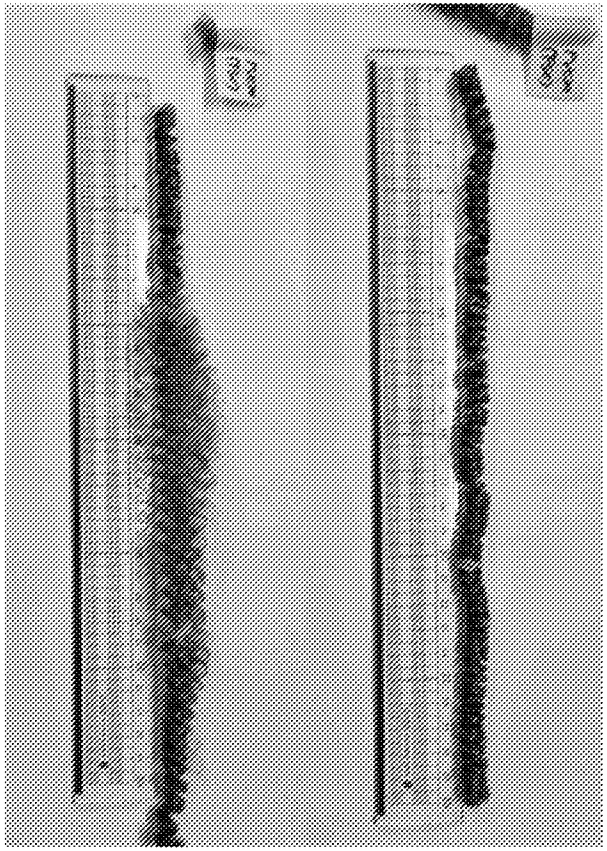
FIG. 17 is an image of a compression-type textured strand prepared in Example 9.

FIG. 17 is an image of a compression-type textured strand prepared in Example 9. In FIG. 17, (a) is a compressed curly braid strand before rapid tension application (PO), and (b) is an extended strand of a lightweight curly braid after rapid tension application (PO).

Comparative Example 1

Preparation of Polyester Filaments

Polyester filaments were prepared in the same manner as in Example 1.

Texturing and Compression of Filaments

4) The direct spun drawn 480 filaments (50 denier/filament: 50×480=24,000 de) were continuously supplied to a pipe with a diameter of 8 mm through the filament supply unit without winding. The filaments were textured by supplying hot air at 185° C. and 8 Kgf/cm$^2$ to the pipe.
5) In the compressive accumulation unit, the balance of input and output of filaments was adjusted to compress the filaments textured in hot air, and the textured filaments were cooled at 15° C. sufficiently and discharged to prepare a compression-type textured strand.

Comparative Example 2 (Low Compression)

Preparation of Polyester Filaments

Polyester (PS) filaments were prepared by using the same method as in Example 1.

Texturing and Compression of Filaments 4) 14 TM (spiral twist, twist per meter) was applied to the directly spun drawn filaments, and the filaments were supplied to a 2-meter-long hot air tunnel maintained at 125° C.
5) After texturing by thermal shrinkage with free tension of the filaments and predetermined compression in a vertical direction of length by rotational twist (spiral twist), the textured filaments became highly dense and were discharged as a circular cross-sectional strand having a diameter of 7 mm. Accordingly, a compression-type textured strand was prepared.

Comparative Example 3 (Thermal Fusion)

Preparation of Polyester Filaments

Polyester filaments were prepared by using the same method as in Example 1.

Texturing and Compression of Filaments 4) 105 TM (spiral twist, twist per meter) was applied to the directly spun drawn filaments, and the filaments were supplied to a 2-meter-long hot air tunnel maintained at 190° C.
5) After texturing by thermal shrinkage with free tension of the filaments and predetermined compression in a vertical direction of length by rotational twist (spiral twist), the textured filaments became highly dense and were discharged as a circular cross-section strand having a diameter of 5 mm. Accordingly, a compression-type textured strand was prepared.

Comparative Example 4 (Low Compression)

Preparation of Polyester Filaments

Polyester filaments were prepared by using the same method as in Example 1.

Texturing and Compression of Filaments

4) The directly spun drawn 320 filaments (47 denier/filament: 47×320=15,040 de) were continuously supplied to a pipe with a diameter of 6 mm through the filament supply unit without winding. The filaments were textured by supplying hot air at 125° C. and 8 Kgf/cm$^2$ to the pipe.
5) In the compressive accumulation unit, the balance of input and output of filaments was adjusted to compress the filaments textured in hot air, and the textured filaments were cooled at 20° C. sufficiently and discharged to prepare a compression-type textured strand.

Comparative Example 5

Preparation of Polyester Filaments

Polyester filaments were prepared by using the same method as in Example 1.

Texturing and Non-Compression of Filaments

The directly spun drawn filaments were wound around an aluminum pipe to form curls, and a compression process was not performed. Accordingly, a non-compression-type textured strand was prepared.

Figure 18:
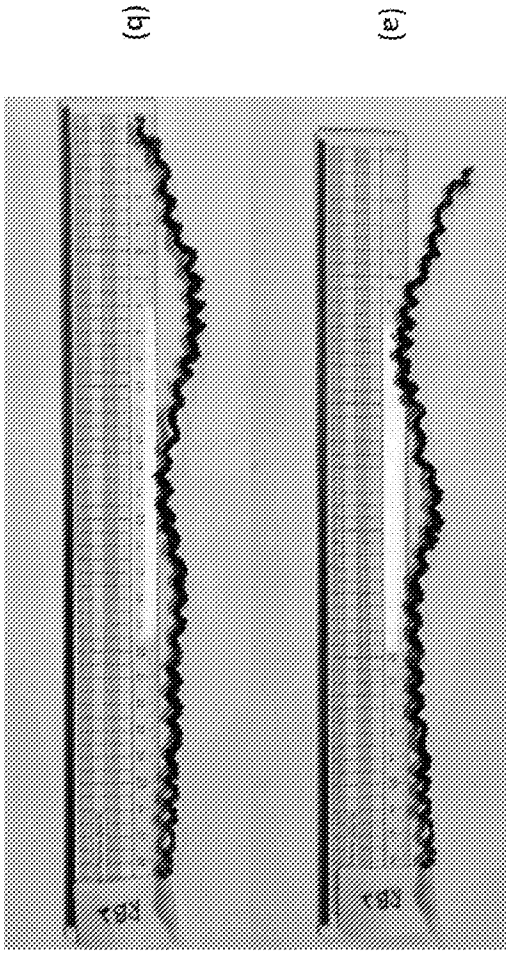
FIG. 18 is an image of a compression-type textured strand prepared in Comparative Example 5.

FIG. 18 is an image of a textured strand prepared in Comparative Example 5. In FIG. 18, (a) is a curly braid strand before rapid tension application (PO), and (b) is an extended strand of a curly braid after rapid tension application (PO).

The filament materials, filament denier, number of filaments, diameter of a hot air nozzle, pneumatic pressure, temperature of a compression pipe, and compression method used in preparation of strands of Examples 1 to 9 and Comparative Examples 1 to 5 are shown in Table 1. In addition, the diameter ($H_0$, $H_2$), BV ($BV_0$, $BV_2$), PO distance (tensile length, $d_1$), SVD ($SVD_0$, $SVD_2$), and increase ratio of SVD ($SVD_{ratio}$), and increase ratio of a cross-sectional area ($S_{ratio}$) of the compression-type textured strand and the non-compression-type textured strand prepared in Examples 1 to 9 and Comparative Examples 1 to 5 before and after rapid tension application (PO) are shown in Table 2.

TABLE 1

| | Material | Filament Denier | Filament Number | Hot air nozzle Diameter | Hot air nozzle pneumatic pressure | Temperature in pipe | Compression method |
|---|---|---|---|---|---|---|---|
| Example 1 | Polyester | 47 | 480 | 0.80 | 2.00 | 120 | Compression in pipe |
| Example 2 | Polyester | 58 | 900 | 1.00 | 6.00 | 160 | Compression in pipe |
| Example 3 | PP | 55 | 480 | 0.70 | 4.00 | 115 | Compression in pipe |
| Example 4 | Polyester | 47 | 480 | 35 (rotational twist) twist per meter | | 120 | Rotational twist compression |
| Example 5 | Polyester | 47 | 480 | 0.80 | 2.00 | 120 | Compression in pipe |
| Example 6 | PP | 50 | 480 | 0.80 | 6.00 | 130 | Compression in pipe |
| Example 7 | PP | 50 | 480 | 1.00 | 8.00 | 130 | Compression in pipe |
| Example 8 | Polyester | 58 | 900 | 1.00 | 2.00 | 120 | Compression in pipe |
| Example 9 | PVC | 50 | 480 | 1.00 | 5.00 | 105 | Compression in pipe |
| Comparative Example 1 | Polyester | 50 | 480 | 0.80 | 8.00 | 185 | Compression in pipe |
| Comparative Example 2 | Polyester | 35 | 480 | 14 (rotational twist) twist per meter | | 125 | Rotational twist compression |
| Comparative Example 3 | Polyester | 47 | 480 | 105 (rotational twist) twist per meter | | 190 | Rotational twist compression |
| Comparative Example 4 | Polyester | 47 | 320 | 0.60 | 8.00 | 125 | Compression in of pipe |
| Comparative Example 5 | Polyester | 47 | 320 | Curl setting by using an Al pipe | | 90 | non-compression |

TABLE 2

| | before PO Diameter ($H_0$) (cm) | BV before PO ($BV_0$) ($cm^3$) | Diameter after PO ($H_2$) (cm) | BV after PO ($BV_2$) ($cm^3$) | PO distance ($d_1$) (cm) | SVD before PO ($SVD_0$) | SVD after PO ($SVD_2$) | $SVD_{ratio}$ | $S_{ratio}$ |
|---|---|---|---|---|---|---|---|---|---|
| Example 1 | 0.80 | 5.02 | 1.20 | 16.39 | 24.50 | 6.89 | 22.49 | 3.26 | 2.25 |
| Example 2 | 1.00 | 7.85 | 1.45 | 18.98 | 24.20 | 9.46 | 22.88 | 2.42 | 2.10 |
| Example 3 | 0.60 | 2.83 | 1.10 | 16.15 | 25.30 | 2.87 | 16.41 | 5.71 | 3.36 |
| Example 4 | 0.80 | 5.02 | 1.00 | 8.64 | 13.20 | 9.08 | 15.61 | 1.72 | 1.56 |
| Example 5 | 0.90 | 6.36 | 1.35 | 26.47 | 46.20 | 6.51 | 27.11 | 4.16 | 2.25 |
| Example 6 | 0.80 | 5.02 | 1.20 | 22.61 | 39.20 | 8.55 | 38.47 | 4.50 | 2.25 |
| Example 7 | 1.00 | 7.85 | 2.40 | 56.52 | 32.80 | 7.13 | 51.34 | 7.20 | 5.76 |
| Example 8 | 1.00 | 7.85 | 1.40 | 17.69 | 26.30 | 10.14 | 22.86 | 2.25 | 1.96 |
| Example 9 | 0.90 | 6.36 | 2.25 | 49.68 | 29.10 | 7.29 | 56.97 | 7.81 | 6.25 |
| Comparative Example 1 | 0.95 | 7.09 | 0.97 | 8.36 | 18.30 | 24.52 | 25.43 | 1.04 | 1.03 |
| Comparative Example 2 | 0.70 | 3.85 | 0.70 | 3.96 | 11.50 | 7.93 | 8.17 | 1.03 | 1.00 |

TABLE 2-continued

| | before PO Diameter ($H_0$) (cm) | BV before PO ($BV_0$) ($cm^3$) | Diameter after PO ($H_2$) (cm) | BV after PO ($BV_2$) ($cm^3$) | PO distance ($d_1$) (cm) | SVD before PO ($SVD_0$) | SVD after PO ($SVD_2$) | $SVD_{ratio}$ | $S_{ratio}$ |
|---|---|---|---|---|---|---|---|---|---|
| Comparative Example 3 | 0.50 | 1.96 | 0.50 | 2.00 | 10.50 | 4.71 | 4.81 | 1.02 | 1.00 |
| Comparative Example 4 | 0.60 | 2.83 | 0.60 | 2.98 | 30.80 | 8.59 | 9.06 | 1.05 | 1.00 |
| Comparative Example 5 | 0.50 | 1.96 | 0.50 | 1.96 | 14.60 | 9.36 | 9.36 | 1.00 | 1.00 |

Referring to Table 2, the compression-type textured strand prepared in Examples 1 to 9 according to the embodiments of the present invention were found to have the increase ratio of SVD ($SVD_{ratio}$) by rapid tension application (PO) of 1.72 to 7.81, which means that the strands were extended by the PO application. Also, referring to FIGS. 15 to 17, it may be seen that the aesthetics of the strands extended by the PO application in the Examples are satisfactory.

On the other hand, the non-compression-type textured strand prepared in Comparative Examples 1 to 5 according to the embodiments of the present invention were found to have an increase ratio of SVD ($SVD_{ratio}$) by rapid tension application (PO) of 1.00 to 1.05, which means that the strands were not extended by the PO application. The results may also be seen in FIG. 18 before and after the PO application of Comparative Example 5.

While one or more example embodiments have been described with reference to the figures and Examples, these are for illustrative purposes only, and it will be understood by those of ordinary skill in the art that various changes may be made therein without departing from the spirit of the present invention. Accordingly, the scope of the present invention should be defined by the following claims.

The invention claimed is:

1. A compression-type strand of textured filament for wigs, wherein the strand comprises at least one of macro-curl textures, macro-wave textures, and micro-flexural textures, in a cross-section of the strand comprising a sheath and a core, there are in a range of 30 to 4,000 filaments from the core to the sheath of the strand, the filaments comprise at least one of an amorphous organic polymer, a semicrystalline organic polymer, or an alloy thereof, the filaments each have a thickness in a range of 20 denier to 180 denier, the cross-section of the strand has a circular shape, an elliptical shape, a polygonal shape, or a combined shape thereof, and when a cross-sectional area is converted into an area of a circular shape, a converted diameter (R), i.e., a diameter of the circular shape, is in a range of 0.2 centimeters (cm) to 3.0 cm, a specific volume ratio (SVD) of the strand is represented by Equation (1):

$$SVD=RD/BD=BV/RV \quad (1)$$

wherein, in Equation (1), a real density (RD) of the strand is a density of one of the individual filaments, the bulk density (BD) of the strand is a density according to a bulk volume (BV) of the strand, and RV is a volume occupied by the filaments, a rapid tension application of the strand being defined as a pulling of the strand at a speed of 150 mm/sec to a tensile length ($d_1$) and releasing the strand 5 seconds later, a specific volume ratio ($SVD_0$) of the strand before the rapid tension application, represented by Equation (2), i.e., a ratio of a real density (RD) to bulk density ($BD_0$), is in a range of 2 to 30:

$$SVD_0=RD/BD_0=BV_0/RV \quad (2)$$

wherein, in Equation (2), a real density (RD) of the strand is a density of the individual filaments, the bulk density ($BD_0$) of the strand is a density according to a bulk volume ($BV_0$) of the strand before rapid tension application, and RV is a volume occupied by the filaments, a length of the strand before rapid tension application is defined as an initial length ($d_0$), wherein a converted diameter of the strand is $R_0$, and a bulk volume of the strand is $BV_0$, wherein the strand is characterized in that:

when the strand undergoes the rapid tension application, the strand has an increase ratio of SVD ($SVD_{ratio}$) in a range of 1.5 to 8 as represented by Equation (3):

$$SVD_{ratio}=SVD_2/SVD_0=BV_2/BV_0 \quad (3)$$

where:

(i) the tensile length ($d_1$) is a length of the strand when a load weight equivalent to 500 times a weight of the strand is hung at an end of the strand in a length direction;

(ii) an initial length (do) of the strand before the rapid tension application is 100 mm; and (iii) $SVD_2$ is a specific volume ratio of the strand measured after the rapid tension application and after being left for one day under conditions of 40° C. and a relative humidity (RH) of 60%, and $BV_2$ is a bulk volume of the strand at an extended length ($d_2$) after the rapid tension application.

2. The compression-type strand of claim 1, wherein after performing the rapid tension application (PO) to the strand, an increase ratio of area ($S_{ratio}$) of a vertical cross-section of the strand, represented by Equation (4), is 1.5 times to 7 times:

$$S_{ratio}=S_2/S_0 \quad (4)$$

wherein, in Equation (4), $S_0$ and $S_2$ respectively represent cross-sectional areas of the strand before and after the rapid tension application (PO).

3. The compression-type strand of claim 1, wherein after the rapid tension application (PO), the cross-section of the strand is extended while maintaining a shape before the rapid tension application (PO).

4. The compression-type strand of claim 1, wherein the strand comprises macro-wave textures, and after the rapid tension application (PO), the macro-wave textures of the strand are extended while maintaining a shape before the rapid tension application (PO).

5. The compression-type strand of claim 1, wherein a shape strain rate of the strand after the rapid tension application (PO), which is represented by Equation (8), is less than 10%:

$$\text{Shape strain rate}=(L_2-L_1)/L_2\times 100 \quad (8)$$

wherein, in Equation (8), after the rapid tension application (PO), $L_1$ represents a length of the strand immediately after the strand is vertically hung under a condition of 40° C. and an RH of 60% and is 24 inches, and after the rapid tension application (PO), $L_2$ represents a length of the strand after vertically hanging the strand of a length ($L_1$) of 24 inches under a condition of 40° C. and an RH of 60% for 24 hours.

6. The compression-type strand of claim 5, wherein the filaments of the strand each have a thickness in a range of 30 denier to 150 denier, a flexural strength of the polymer constituting the filaments is in a range of 300 kgf/cm$^2$ to 1,300 kgf/cm$^2$, and a flexural modulus of the polymer constituting the filaments (based on ASTM D790) is in a range of 13,000 kgf/cm$^2$ to 36,000 kgf/cm$^2$.

7. The compression-type strand of claim 5, wherein the filaments of the strand each have a thickness in a range of 30 denier to 150 denier, a flexural strength of the polymer constituting the filaments is in a range of 600 kgf/cm$^2$ to 1,200 kgf/cm$^2$, and a flexural modulus of the polymer constituting the filaments (based on ASTM D790) is in a range of 20,000 kgf/cm$^2$ to 35,000 kgf/cm$^2$.

8. The compression-type strand of claim 1, wherein the strand is a LOC braid type, SVD before the rapid tension application (PO) is in a range of 3 to 15, and an increase ratio of SVD ($SVD_{ratio}$) due to the rapid tension application (PO) is in a range of 1.5 to 6.

9. The compression-type strand of claim 1, wherein the strand is a LOC braid type, a change to a Marley braid type may occur due to the rapid tension application (PO), wherein macro-wave textures and micro-flexural textures are simultaneously expressed in the Marley braid type, SVD before the rapid tension application (PO) is in a range of 5 to 20, and an increase ratio of SVD ($SVD_{ratio}$) due to the rapid tension application (PO) is in a range of 2 to 8.

10. The compression-type strand of claim 1, wherein the strand is a curly braid type, SVD before the rapid tension application (PO) is in a range of 10 to 30, and an increase ratio of SVD ($SVD_{ratio}$) due to the rapid tension application (PO) is in a range of 2 to 8.

11. The compression-type strand of claim 1, wherein the strand is a twist braid (cross twisted filament-bundle) type, SVD before the rapid tension application (PO) is in a range of 2 to 10, and an increase ratio of SVD ($SVD_{ratio}$) due to the rapid tension application (PO) is in a range of 1.5 to 4.

12. The compression-type strand of claim 1, wherein the strand is a box braid (braided filament-bundle) type, SVD before the rapid tension application (PO) is in a range of 2 to 10, and an increase ratio of SVD ($SVD_{ratio}$) due to the rapid tension application (PO) is in a range of 1.5 to 4.

13. The compression-type strand of claim 1, wherein the strand comprises one or more of a rotational-twisted or spiral-twisted filament-bundle, the strand is a textured compressed high-density (closely contacted) compression-type strand of TM braid type by grouping a plurality of TM bundles, the strand is separated into as many as a number of rotational-twisted or spiral-twisted bundles, and SVD of each separated bundle before the rapid tension application (PO) is in a range of 3 to 10, and an increase ratio of SVD (SVDratio) of each of the rotational-twisted or spiral-twisted bundles after the rapid tension application (PO) is extended to 1.5 to 6, and each of the rotational-twisted or spiral-twisted bundles is converted into a lightweight distorted LOC braid in which irregular waves are expressed.

14. The compression-type strand of claim 1, wherein the strand exhibits outward curls, and the outward curls are formed in one of an S direction (right) and a Z direction (left).

15. The compression-type strand of claim 1, wherein the strand exhibits outward curls, and an S direction (right) and a Z direction (left) alternately appear in the outward curls.

16. The compression-type strand of claim 1, wherein the length of the strand is 2 meters (m) or longer.

17. A method of preparing a compression-type strand of textured filament for wigs according to claim 1, the method comprising:

supplying a plurality of wig filaments for use in wigs;

texturing the filaments;

compressing and accumulating the textured filaments; and cooling the compressed and accumulated filaments.

18. A method of converting a compression-type strand of textured filament for wigs, wherein the compression-type strand prepared according to claim 17 has an increase ratio of SVD ($SVD_{ratio}$) of the strand in a range of 1.5 to 8 by applying rapid tension (PO).

* * * * *